US006476766B1

(12) United States Patent
Cohen

(10) Patent No.: US 6,476,766 B1
(45) **Date of Patent: *Nov. 5, 2002**

(54) FRACTAL ANTENNA GROUND COUNTERPOISE, GROUND PLANES, AND LOADING ELEMENTS AND MICROSTRIP PATCH ANTENNAS WITH FRACTAL STRUCTURE

(76) Inventor: Nathan Cohen, 2 Ledgewood Pl., Belmont, MA (US) 02178

( * ) Notice: Subject to any disclaimer, the term of this patent is extended or adjusted under 35 U.S.C. 154(b) by 0 days.

This patent is subject to a terminal disclaimer.

(21) Appl. No.: 09/677,645

(22) Filed: Oct. 3, 2000

Related U.S. Application Data

(63) Continuation of application No. 08/967,375, filed on Nov. 7, 1997, now Pat. No. 6,140,975, and a continuation of application No. 08/965,914, filed on Nov. 7, 1997, now Pat. No. 6,127,977.

(51) Int. Cl.[7] ..... H01Q 1/38

(52) U.S. Cl. ..... 343/700 MS; 343/792.5; 343/846

(58) Field of Search ..... 343/700 MS, 702, 343/846, 792.5, 895; H01Q 1/36, 1/38

(56) References Cited

U.S. PATENT DOCUMENTS 3,079,602 A * 2/1963 DuHamel et al. ..... 343/792.5
5,313,216 A * 5/1994 Wang et al. ..... 343/700 MS
5,608,413 A * 3/1997 Macdonald ..... 343/700 MS
6,104,349 A * 8/2000 Cohen ..... 343/702
6,104,975 A * 10/2000 Cohen ..... 343/846
6,127,977 A * 10/2000 Cohen ..... 343/700 MS

* cited by examiner

*Primary Examiner*—Michael C. Wimer
(74) *Attorney, Agent, or Firm*—McDermott, Will & Emery

(57) ABSTRACT

An antenna system includes a fractalized element that may be a ground counterpoise, a top-hat located load assembly, or a microstrip patch antenna having at least one element whose physical shape is at least partially defined as a first or higher iteration deterministic fractal. The resultant fractal element may rely upon an opening angle for performance, and is more compact than non-Euclidean ground counterpoise elements or the like. A vertical antenna system includes a vertical element that may also be a fractal, and a vertical antenna can include vertically spaced-apart fractal conductive and passive elements, and at least one fractal ground element. Various antenna configurations may be fabricated on opposite surfaces of a substrate, including a flexible substrate, and may be tuned by rotating elements relative to each other, and/or by varying the spaced-apart distance therebetween. Fractalized ground counterpoise elements and/or microstrip patch antenna systems may be fabricated on a flexible printed circuit substrate, and/or placed within the support mount of a cellular telephone car antenna.

8 Claims, 25 Drawing Sheets

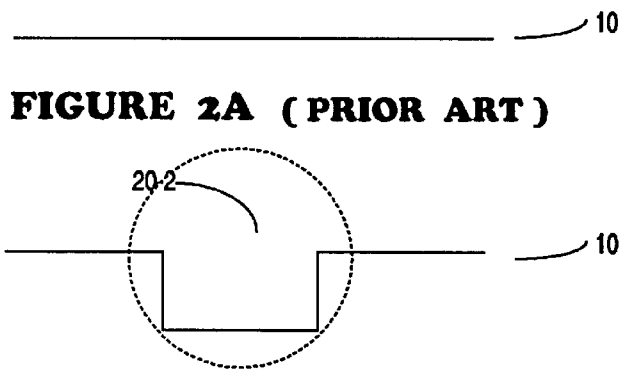
FIGURE 2A (PRIOR ART)
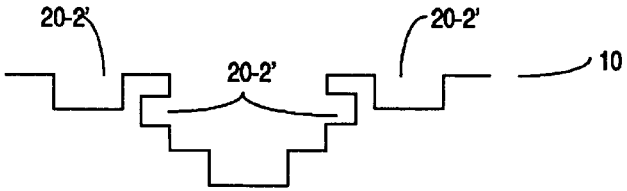
FIGURE 2B (PRIOR ART)
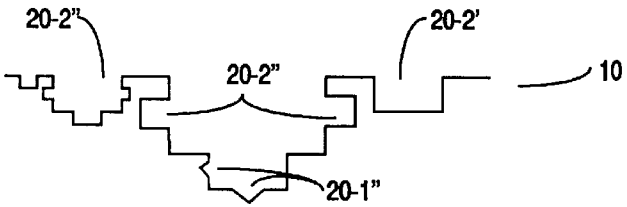
FIGURE 2C (PRIOR ART)
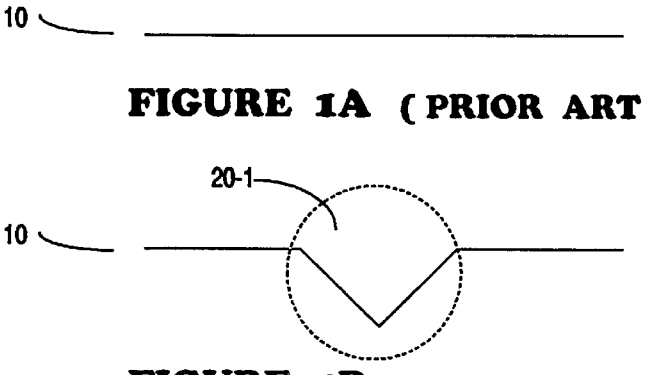
FIGURE 2D (PRIOR ART)
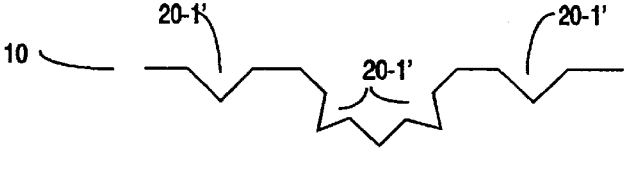
FIGURE 1A (PRIOR ART)
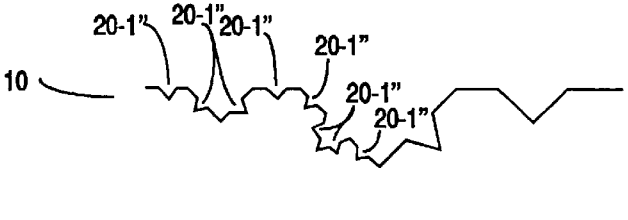
FIGURE 1B (PRIOR ART)
FIGURE 1C (PRIOR ART)
FIGURE 1D (PRIOR ART)

FRACTAL ANTENNA GROUND COUNTERPOISE, GROUND PLANES, AND LOADING ELEMENTS AND MICROSTRIP PATCH ANTENNAS WITH FRACTAL STRUCTURE

RELATION TO PREVIOUSLY FILED PATENT APPLICATIONS

This application is a continuing application from applicant's patent application Ser. No. 08/967,375 entitled FRACTAL ANTENNA GROUND COUNTERPOISE, GROUND PLANES, AND LOADING ELEMENTS, filed Nov. 7, 1997, now U.S. Pat. No. 6,140,975, and from applicant's patent application Ser. No. 08/965,914 entitled MICROSTRIP PATCH ANTENNA WITH FRACTAL STRUCTURE, filed Nov. 7, 1997, now U.S. Pat. No. 6,127,977 (Oct. 3, 2000). Applicant incorporates by reference herein his U.S. Pat. No. 6,104,349 (Aug. 15, 2000) entitled TUNING FRACTAL ANTENNAS AND FRACTAL RESONATORS.

FIELD OF THE INVENTION

The present invention relates to antennas and resonators, and microstrip patch antennas, and specifically to designing and tuning non-Euclidian antenna ground radials, ground counterpoise or planes, top-loading elements, and antennas using such elements and to providing microstrip patch antennas with fractal structure elements.

BACKGROUND OF THE INVENTION

Antenna are used to radiate and/or receive typically electromagnetic signals, preferably with antenna gain, directivity, and efficiency. Practical antenna design traditionally involves trade-offs between various parameters, including antenna gain, size, efficiency, and bandwidth.

Antenna design has historically been dominated by Euclidean geometry. In such designs, the closed antenna area is directly proportional to the antenna perimeter. For example, if one doubles the length of an Euclidean square (or "quad") antenna, the enclosed area of the antenna quadruples. Classical antenna design has dealt with planes, circles, triangles, squares, ellipses, rectangles, hemispheres, paraboloids, and the like, (as well as lines). Similarly, resonators, typically capacitors ("C") coupled in series and/or parallel with inductors ("L"), traditionally are implemented with Euclidian inductors.

With respect to antennas, prior art design philosophy has been to pick a Euclidean geometric construction, e.g., a quad, and to explore its radiation characteristics, especially with emphasis on frequency resonance and power patterns. The unfortunate result is that antenna design has far too long concentrated on the ease of antenna construction, rather than on the underlying electromagnetics.

Many prior art antennas are based upon closed-loop or island shapes. Experience has long demonstrated that small sized antennas, including loops, do not work well, one reason being that radiation resistance ("R") decreases sharply when the antenna size is shortened. A small sized loop, or even a short dipole, will exhibit a radiation pattern of ½λ and ¼λ, respectively, if the radiation resistance R is not swamped by substantially larger ohmic ("O") losses. Ohmic losses can be minimized using impedance matching networks, which can be expensive and difficult to use. But although even impedance matched small loop antennas can exhibit 50% to 85% efficiencies, their bandwidth is inherently narrow, with very high Q, e.g., Q>50. As used herein, Q is defined as (transmitted or received frequency)/(3 dB bandwidth).

As noted, it is well known experimentally that radiation resistance R drops rapidly with small area Euclidean antennas. However, the theoretical basis is not generally known, and any present understanding (or misunderstanding) appears to stem from research by J. Kraus, noted in *Antennas* (Ed. 1), McGraw Hill, New York (1950), in which a circular loop antenna with uniform current was examined. Kraus' loop exhibited a gain with a surprising limit of 1.8 dB over an isotropic radiator as loop area fells below that of a loop having a 1λ-squared aperture. For small loops of area $A<\lambda^2/100$, radiation resistance R was given by:

$$R = K \cdot \left(\frac{A}{\lambda^2}\right)^2$$

where K is a constant, A is the enclosed area of the loop, and λ is wavelength. Unfortunately, radiation resistance R can all too readily be less than 1Ω for a small loop antenna.

From his circular loop research Kraus generalized that calculations could be defined by antenna area rather than antenna perimeter, and that his analysis should be correct for small loops of any geometric shape. Kraus' early research and conclusions that small-sized antennas will exhibit a relatively large ohmic resistance O and a relatively small radiation resistance R, such that resultant low efficiency defeats the use of the small antenna have been widely accepted. In fact, some researchers have actually proposed reducing ohmic resistance O to 0Ω by constructing small antennas from superconducting material, to promote efficiency.

As noted, prior art antenna and resonator design has traditionally concentrated on geometry that is Euclidean. However, one non-Euclidian geometry is fractal geometry. Fractal geometry may be grouped into random fractals, which are also termed chaotic or Brownian fractals and include a random noise components, such as depicted in FIG. 3, or deterministic fractals such as shown in FIG. 1C.

In deterministic fractal geometry, a self-similar structure results from the repetition of a design or motif (or "generator"), on a series of different size scales. One well known treatise in this field is *Fractals, Endlessly Repeated Geometrical Figures,* by Hans Lauwerier, Princeton University Press (1991), which treatise applicant refers to and incorporates herein by reference. FIGS. 1A–2D depict the development of some elementary forms of fractals. In FIG. 1A, a base element 10 is shown as a straight line, although a curve could instead be used. In FIG. 1B, a so-called Koch fractal motif or generator 20-1, here a triangle, is inserted into base element 10, to form a first order iteration ("N") design, e.g., N=1. In FIG. 1C, a second order N=2 iteration design results from replicating the triangle motif 20-1 into each segment of FIG. 1B, but where the 20-1' version has been differently scaled, here reduced in size. As noted in the Lauwerier treatise, in its replication, the motif may be rotated, translated, scaled in dimension, or a combination of any of these characteristics. Thus, as used herein, second order of iteration or N=2 means the fundamental motif has been replicated, after rotation, translation, scaling (or a combination of each) into the first order iteration pattern. A higher order, e.g., N=3, iteration means a third fractal pattern has been generated by including yet another rotation, translation, and/or scaling of the first order motif.

In FIG. 1D, a portion of FIG. 1C has been subjected to a further iteration (N=3) in which scaled-down versions of the triangle motif 20-1 have been inserted into each segment of the left half of FIG. 1C. FIGS. 2A–2C follow what has been described with respect to FIGS. 1A–1C, except that a rectangular motif 20-2 has been adopted. FIG. 2D shows a pattern in which a portion of the left-hand side is an N=3 iteration of the 20-2 rectangle motif, and in which the center portion of the figure now includes another motif, here a 20-1 type triangle motif, and in which the right-hand side of the figure remains an N=2 iteration.

Traditionally, non-Euclidean designs including random fractals have been understood to exhibit antiresonance characteristics with mechanical vibrations. It is known in the art to attempt to use non-Euclidean random designs at lower frequency regimes to absorb, or at least not reflect sound due to the antiresonance characteristics. For example, M. Schroeder in *Fractals, Chaos, Power Laws* (1992), W. H. Freeman, New York discloses the use of presumably random or chaotic fractals in designing sound blocking diffusers for recording studios and auditoriums.

Experimentation with non-Euclidean structures has also been undertaken with respect to electromagnetic waves, including radio antennas. In one experiment, Y. Kim and D. Jaggard in *The Fractal Random Array*, Proc. IEEE 74, 1278–1280 (1986) spread-out antenna elements in a sparse microwave array, to minimize sidelobe energy without having to use an excessive number of elements. But Kim and Jaggard did not apply a fractal condition to the antenna elements, and test results were not necessarily better than any other techniques, including a totally random spreading of antenna elements. More significantly, the resultant array was not smaller than a conventional Euclidean design.

Prior art spiral antennas, cone antennas, and V-shaped antennas may be considered as a continuous, deterministic first order fractal, whose motif continuously expands as distance increases from a central point. A log-periodic antenna may be considered a type of continuous fractal in that it is fabricated from a radially expanding structure. However, log periodic antennas do not utilize the antenna perimeter for radiation, but instead rely upon an arc-like opening angle in the antenna geometry. Such opening angle is an angle that defines the size-scale of the log-periodic structure, which structure is proportional to the distance from the antenna center multiplied by the opening angle. Further, known log-periodic antennas are not necessarily smaller than conventional driven element-parasitic element antenna designs of similar gain.

Unintentionally, first order fractals have been used to distort the shape of dipole and vertical antennas to increase gain, the shapes being defined as a Brownian-type of chaotic fractals, See F. Landstorfer and R. Sacher, *Optimisation of Wire Antennas*, J. Wiley, New York (1985). FIG. 3 depicts three bent-vertical antennas developed by Landstorfer and Sacher through trial and error, the plots showing the actual vertical antennas as a function of x-axis and y-axis coordinates that are a function of wavelength. The "EF" and "BF"nomenclature in FIG. 3 refer respectively to end-fire and back-fire radiation patterns of the resultant bent-vertical antennas.

First order fractals have also been used to reduce horn-type antenna geometry, in which a double-ridge horn configuration is used to decrease resonant frequency. See J. Kraus in *Antennas*, McGraw Hill, New York (1885). The use of rectangular, box-like, and triangular shapes as impedance-matching loading elements to shorten antenna element dimensions is also known in the art.

Whether intentional or not, such prior art attempts to use a quasi-fractal or fractal motif in an antenna employ at best a first order iteration fractal. By first iteration it is meant that one Euclidian structure is loaded with another Euclidean structure in a repetitive fashion, using the same size for repetition. FIG. 1C, for example, is not first order because the 20-1' triangles have been shrunk with respect to the size of the first motif 20-1.

So-called microstrip patch antennas have traditionally been fabricated as two spaced-apart metal surfaces separated by a small width dielectric. The sides are dimensioned typically one-quarter wavelength or one-half wavelength at the frequency of interest. One surface is typically a simple Euclidean structure such as a circle, a square, while the other side is a ground plane. Attempting to reduce the physical size of such an antenna for a given frequency typically results in a poor feedpoint match (e.g., to coaxial or other feed cable), poor radiation bandwidth, among other difficulties.

Prior art antenna design does not attempt to exploit multiple scale self-similarity of real fractals. This is hardly surprising in view of the accepted conventional wisdom that because such antennas would be anti-resonators, and/or if suitably shrunken would exhibit so small a radiation resistance R, that the substantially higher ohmic losses O would result in too low an antenna efficiency for any practical use. Further, it is probably not possible to mathematically predict such an antenna design, and high order iteration fractal antennas would be increasingly difficult to fabricate and erect, in practice. The use of fractals, especially higher order fractals, in fabricating microstrip patch antennas has not been investigated in the prior art.

FIGS. 4A and 4B depict respective prior art series and parallel type resonator configurations, comprising capacitors C and Euclidean inductors L. In the series configuration of FIG. 4A, a notch-filter characteristic is presented in that the impedance from port A to port B is high except at frequencies approaching resonance, determined by $1/\sqrt{(LC)}$.

In the distributed parallel configuration of FIG. 4B, a low-pass filter characteristic is created in that at frequencies below resonance, there is a relatively low impedance path from port A to port B, but at frequencies greater than resonant frequency, signals at port A are shunted to ground (e.g., common terminals of capacitors C), and a high impedance path is presented between port A and port B. Of course, a single parallel LC configuration may also be created by removing (e.g., short-circuiting) the rightmost inductor L and right two capacitors C, in which case port B would be located at the bottom end of the leftmost capacitor C.

In FIGS. 4A and 4B, inductors L are Euclidean in that increasing the effective area captured by the inductors increases with increasing geometry of the inductors, e.g., more or larger inductive windings or, if not cylindrical, traces comprising inductance. In such prior art configurations as FIGS. 4A and 4B, the presence of Euclidean inductors L ensures a predictable relationship between L, C and frequencies of resonance.

Applicant's cited applications provide design methodologies to produce smaller-scale antennas that can exhibit at least as much gain, directivity, and efficiency as larger Euclidean counterparts. Such design approach should exploit the multiple scale self-similarity of real fractals, including $N \geqq 2$ iteration order fractals. Further, said application disclosed a non-Euclidean resonator whose presence in a resonating configuration can create frequencies of resonance beyond those normally presented in series and/or parallel LC configurations. Applicant's above-noted TUNING FRACTAL ANTENNAS AND FRACTAL RESONATORS patent disclosed devices and methods for tuning and/or adjusting such antennas and resonators. This patent further disclosed the use of non-Euclidean resonators whose presence in a resonating configuration could create frequencies of resonance beyond those normally presented in series and/or parallel LC configurations.

However, such antenna design approaches and tuning approaches should also be useable with vertical antennas, permitting the downscaling of one or more radial ground plane elements, and/or ground planes, and/or ground counterpoises, and/or top-hat loading elements. Further, such antenna design approaches and tuning approaches should also be useable with microstrip patch antennas and elements for such antennas. Thus, there is a need for a method by which microstrip patch antennas could be made smaller without sacrificing antenna bandwidth, while preserving good feedpoint impedance matching, and while maintaining acceptable gain and frequency characteristics.

The present invention provides such antennas, radial ground plane elements, ground planes, ground counterpoises, and top-hat loading elements, as well as methods for their design, and further provides such microstrip patch antennas, and elements for such antennas.

SUMMARY OF THE INVENTION

In one aspect, the present invention provides an antenna with a ground plane or ground counterpoise system that has at least one element whose shape, at least is part, is substantially a deterministic fractal of iteration order $N \geqq 1$. (The term "ground counterpoise" will be understood to include a ground plane, and/or at least one ground element.) Using fractal geometry, the antenna ground counterpoise has a self-similar structure resulting from the repetition of a design or motif (or "generator") that is replicated using rotation, and/or translation, and/or scaling. The fractal element will have x-axis, y-axis coordinates for a next iteration N+1 defined by $x_{N+1}=f(x_N, yb_N)$ and $y_{N+1}=g(x_N, y_N$, where $x_N$, $y_N$ define coordinates for a preceding iteration, and where f(x,y) and g(x,y) are functions defining the fractal motif and behavior. In another aspect, a vertical antenna is top-loaded with a so-called top-hat assembly that includes at least one fractal element. A fractalized top-hat assembly advantageously reduces resonant frequency, as well as the physical size and area required for the top-hat assembly.

In contrast to Euclidean geometric antenna design, deterministic fractal elements according to the present invention have a perimeter that is not directly proportional to area. For a given perimeter dimension, the enclosed area of a multi-iteration fractal will always be as small or smaller than the area of a corresponding conventional Euclidean element.

A fractal antenna has a fractal ratio limit dimension D given by log(L)/log(r), where L and r are one-dimensional antenna element lengths before and after fractalization, respectively.

As used herein, a fractal antenna perimeter compression parameter (PC) is defined as:

$$PC = \frac{\text{full-sized antenna element length}}{\text{fractal-reduced antenna element length}}$$

where:

$$PC = A \cdot \log[N(D+C)]$$

in which A and C are constant coefficients for a given fractal motif, N is an iteration number, and D is the fractal dimension, defined above.

Radiation resistance (R) of a fractal antenna decreases as a small power of the perimeter compression (PC), with a fractal loop or island always exhibiting a substantially higher radiation resistance than a small Euclidean loop antenna of equal size. In the present invention, deterministic fractals are used wherein A and C have large values, and thus provide the greatest and most rapid element-size shrinkage. A fractal antenna according to the present invention will exhibit an increased effective wavelength.

The number of resonant nodes of a fractal loop-shaped antenna increases as the iteration number N and is at least as large as the number of resonant nodes of an Euclidean island with the same area. Further, resonant frequencies of a fractal antenna include frequencies that are not harmonically related.

An antenna including a fractal ground counterpoise according to the present invention is smaller than its Euclidean counterpart but provides at least as much gain and frequencies of resonance and provides a reasonable termination impedance at its lowest resonant frequency. Such an antenna system can exhibit non-harmonically frequencies of resonance, a low Q and resultant good bandwidth, acceptable standing wave ratio ("SWR"), and a radiation impedance that is frequency dependent, and high efficiencies.

With respect to vertical antennas, the present invention enables such antennas to be realized with a smaller vertical element, and/or with smaller ground counterpoise, e.g., ground plane radial elements, and/or ground plane. The ground counterpoise element(s) are fractalized with $N \geqq 1$. In a preferred embodiment, the vertical element is also a fractal system, preferably comprising first and second spaced-apart fractal elements.

A fractal antenna system having a fractal ground counterpoise and a fractal vertical preferably is tuned according to applicant's above-referenced TUNING FRACTAL ANTENNAS AND FRACTAL RESONATORS patent, by placing an active (or driven) fractal antenna or resonator a distance $\Delta$ from a second conductor. Such disposition of the antenna and second conductor advantageously lowers resonant frequencies and widens bandwidth for the fractal antenna. In some embodiments, the fractal antenna and second conductor are non-coplanar and $\lambda$ is the separation distance therebetween, preferably $\leqq 0.05\lambda$ for the frequency of interest $(1/\lambda)$. In other embodiments, the fractal antenna and second conductive element may be planar, in which case $\lambda$ a separation distance, measured on the common plane. In another embodiment, an antenna is loaded with a fractal "top-hat" assembly, which can provide substantial reduction in antenna size.

The second conductor may in fact be a second fractal antenna of like or unlike configuration as the active antenna. Varying the distance $\Delta$ tunes the active antenna and thus the overall system. Further, if the second element, preferably a fractal antenna, is angularly rotated relative to the active antenna, resonant frequencies of the active antenna may be varied.

Providing a cut in the fractal antenna results in new and different resonant nodes, including resonant nodes having perimeter compression parameters, defined below, ranging from about three to ten. If desired, a portion of a fractal antenna may be cutaway and removed so as to tune the antenna by increasing resonance(s).

Tunable antenna systems with a fractal ground counterpoise need not be planar, according to the present invention. Fabricating the antenna system around a form such as a toroid ring, or forming the fractal antenna on a flexible substrate that is curved about itself results in field self-proximity that produces resonant frequency shifts. A fractal antenna and a conductive element may each be formed as a curved surface or even as a toroid-shape, and placed in sufficiently close proximity to each other to provide a useful tuning and system characteristic altering mechanism.

In the various embodiments, more than two elements may be used, and tuning may be accomplished by varying one or more of the parameters associated with one or more elements.

In a second aspect, the present invention provides a microstrip patch antenna comprising spaced-apart first and second conductive surfaces separated by a dielectric material. The dielectric material thickness preferably is substantially less than one wavelength for the frequency of interest.

At least one of the surfaces is fabricated to define a fractal pattern of first or higher iteration order. Overall dimensions of the surfaces may be reduced below the one-quarter to one-half wavelength commonly found in the prior art.

Radio frequency feedline coupling to the microstrip patch antenna may be made at a location on the antenna pattern structure, or through a conductive feedtab strip that may be fabricated along with the conductive pattern on one or both surfaces of the antenna. The resultant antenna may be sized smaller than a non-fractal counterpart (e.g., approximately one-eighth wavelength provides good performance at about 900 MHz.) while preserving good, preferably 50Ω, feed-point impedance. Further bandwidth can actually be increased, and resonant frequency lowered.

Components from the generally-described first and second aspects of the present invention may be combined.

Other features and advantages of the invention will appear from the following description in which the preferred embodiments have been set forth in detail, in conjunction with the accompanying drawings.

BRIEF DESCRIPTION OF THE DRAWINGS

FIG. 1C depicts a second-iteration fractal using the motif of FIG. 1B, according to the prior art;

FIG. 1D depicts a third-iteration fractal using the motif of FIG. 1B, according to the prior art;

FIG. 2C depicts a second-iteration fractal using the motif of FIG. 2B, according to the prior art;

FIG. 2D depicts a fractal configuration including a third-order using the motif of FIG. 2B, as well as the motif of FIG. 1B, according to the prior art;

FIG. 7C-2 depicts a second iteration Minkowski (MI-2) slot fractal antenna, according to the present invention;

FIG. 7D-1A depicts a 0.25λ vertical antenna with three 0.25λ radial ground elements, according to the prior art;

FIG. 7D-1B depicts the gain pattern for the antenna of FIG. 7D-1A;

FIG. 7D-2A depicts a 0.25λ vertical antenna with three fractal radial ground elements according to the present invention;

FIG. 7D-2B depicts the gain pattern for the antenna of FIG. 7D-2A;

FIG. 7D-3A depicts a "top-hat" loaded antenna, according to the prior art;

FIG. 7D-3B depicts the gain pattern for the antenna of FIG. 7D-3A;

FIG. 7D-4A depicts a ternary fractal "top-hat" loaded antenna, according the present invention;

FIG. 7D-4B depicts the gain pattern for the antenna of FIG. 7D-4A;

FIG. 7D-5 depicts an antenna having a fractal vertical element and fractal radial ground elements, according to the present invention;

DETAILED DESCRIPTION OF THE PREFERRED EMBODIMENTS

Figure 3:
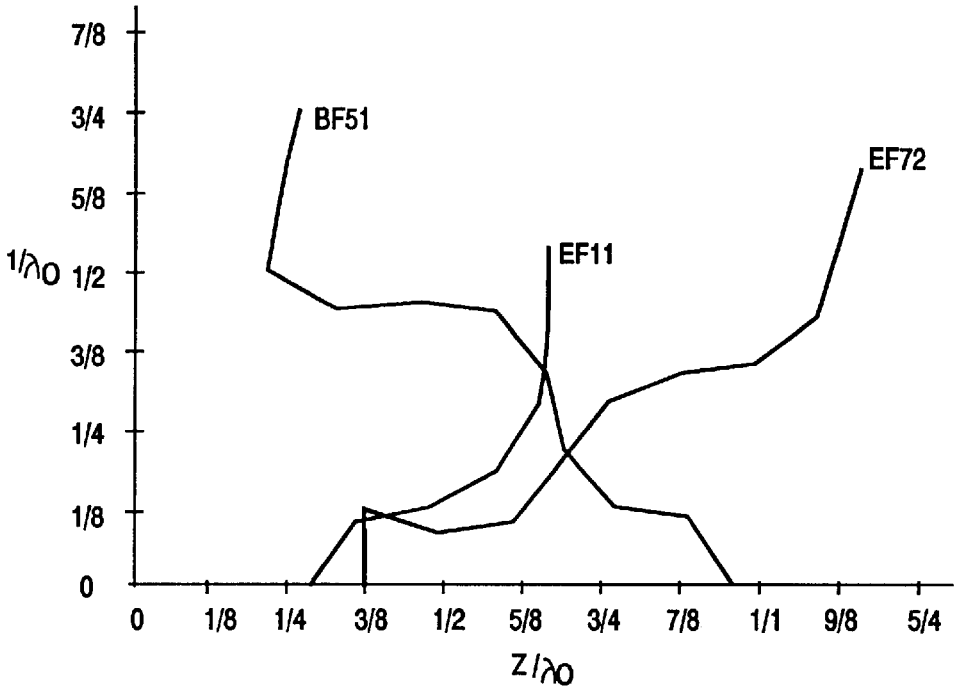
FIGURE 3 (PRIOR ART)
FIG. 3 depicts bent-vertical chaotic fractal antennas, according to the prior art.

In overview, in one aspect, the present invention provides an antenna system with a fractal ground counterpoise, e.g., a counterpoise and/or ground plane and/or ground element having at least one element whose shape, at least is part, is substantially a fractal of iteration order N≧1. The resultant antenna is smaller than its Euclidean counterpart, provides close to 50Ω termination impedance, exhibits at least as much gain and more frequencies of resonance than its Euclidean counterpart, including non-harmonically related frequencies of resonance, exhibits a low Q and resultant good bandwidth, acceptable SWR, a radiation impedance that is frequency dependent, and high efficiencies.

In another aspect, the present invention provides a microstrip patch antenna with at least one element whose shape, at least is part, is substantially a fractal of iteration order N≧1. The resultant antenna is smaller than its Euclidean counterpart, provides close to 50Ω termination impedance, exhibits acceptable gain, increased bandwidth, and decreased resonant frequency than its Euclidean counterpart.

In contrast to Euclidean geometric antenna design, a fractal element including a fractal antenna ground counterpoise according to the present invention has a perimeter that is not directly proportional to area. For a given perimeter dimension, the enclosed area of a multi-iteration fractal area will always be at least as small as any Euclidean area.

Using fractal geometry, the ground element has a self-similar structure resulting from the repetition of a design or motif (or "generator"), which motif is replicated using rotation, translation, and/or scaling (or any combination thereof). The fractal portion of the element has x-axis, y-axis coordinates for a next iteration N+1 defined by $x_{N+1}=f(x_N, yb_N)$ and $y_{N+1}=g(x_N, y_N)$, where $x_N$, $y_N$ are coordinates of a preceding iteration, and where f(x,y) and g(x,y) are functions defining the fractal motif and behavior.

For example, fractals of the Julia set may be represented by the form:

$$x_{N+1}=x_N^2-y_N^2+a$$

$$y_{N+1}=2x_N \cdot y_N=b$$

In complex notation, the above may be represented as:

$$z_{N+1}=z_N^2+c$$

Although it is apparent that fractals can comprise a wide variety of forms for functions f(x,y) and g(x,y), it is the iterative nature and the direct relation between structure or morphology on different size scales that uniquely distinguish f(x,y) and g(x,y) from non-fractal forms. Many references including the Lauwerier treatise set forth equations appropriate for f(x,y) and g(x,y).

Iteration (N) is defined as the application of a fractal motif over one size scale. Thus, the repetition of a single size scale of a motif is not a fractal as that term is used herein. Multi-fractals may of course be implemented, in which a motif is changed for different iterations, but eventually at least one motif is repeated in another iteration.

The first aspect of the present invention will now be described with reference to FIGS. 5A–15, and then the second aspect will be described with reference to FIGS. 16–18. As noted, elements of each aspect may be combined.

Figure 5B:
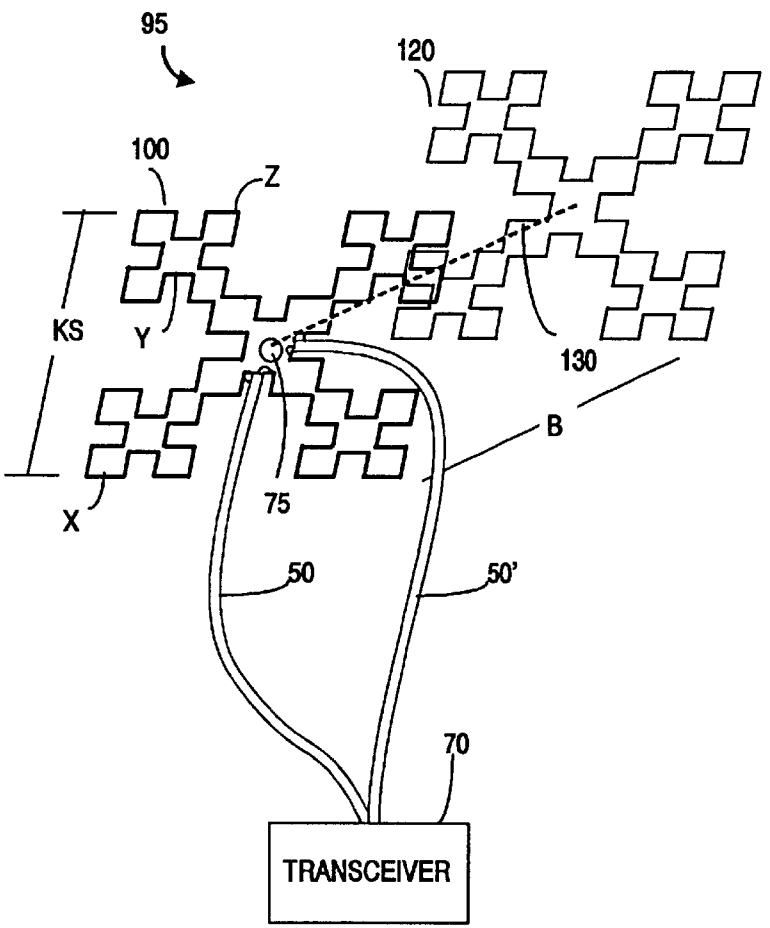
FIG. 5B depicts a second-order Minkowski island fractal quad antenna, according to the present invention.
Figure 5A:
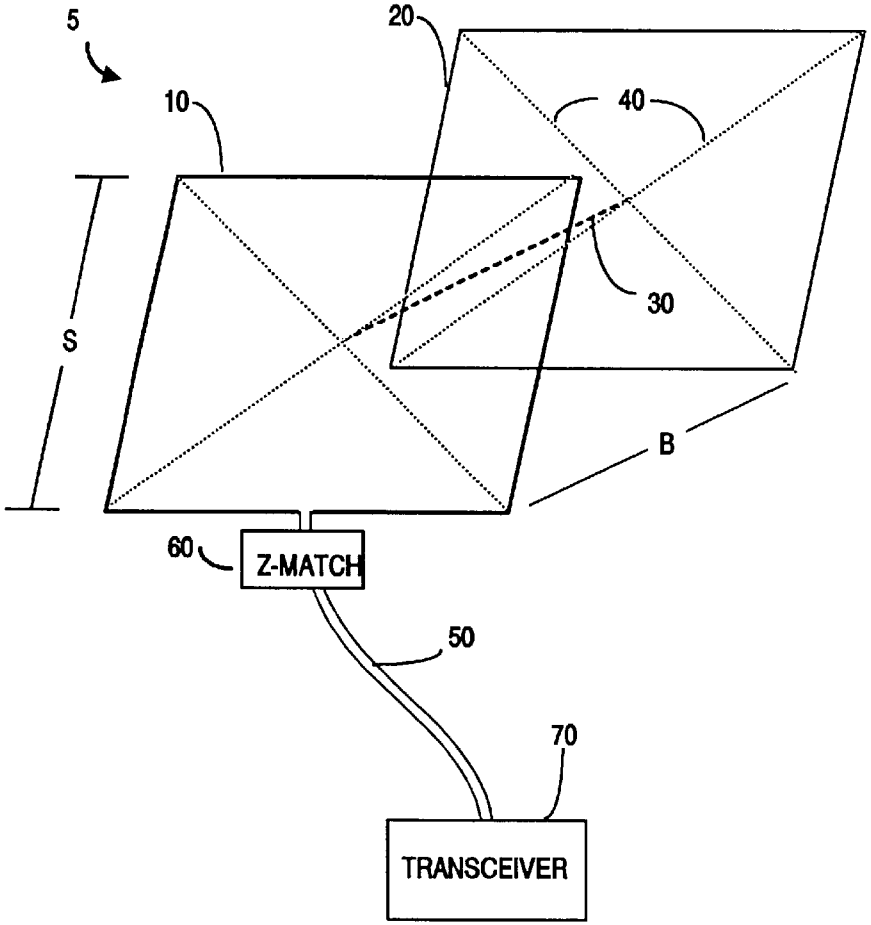
FIGURE 5A (PRIOR ART)
FIG. 5A depicts an Euclidean quad antenna system, according to the prior art.

An overall appreciation of the present invention, and especially the first aspect thereof, may be obtained by comparing FIGS. 5A and 5B. FIG. 5A shows a conventional Euclidean quad antenna 5 having a driven element 10 whose four sides are each 0.25λlong, for a total perimeter of 1λ, where λ is the frequency of interest.

Euclidean element 10 has an impedance of perhaps 130Ω, which impedance decreases if a parasitic quad element 20 is spaced apart on a boom 30 by a distance B of 0.1λ to 0.25λ. Parasitic element 20 is also sized S=0.25λ on a side, and its presence can improve directivity of the resultant two-element quad antenna. Element 10 is depicted in FIG. 5A with heavier lines than element 20, solely to avoid confusion in understanding the figure. Non-conductive spreaders 40 are used to help hold element 10 together and element 20 together.

Because of the relatively large drive impedance, driven element 10 is coupled to an impedance matching network or device 60, whose output impedance is approximately 50Ω. A typically 50Ω coaxial cable 50 couples device 60 to a transceiver 70 or other active or passive electronic equipment 70.

As used herein, the term transceiver shall mean a piece of electronic equipment that can transmit, receive, or transmit and receive an electromagnetic signal via an antenna, such as the quad antenna shown in FIG. 5A or 5B. As such, the term transceiver includes without limitation a transmitter, a receiver, a transmitter-receiver, a cellular telephone, a wireless telephone, a pager, a wireless computer local area network ("LAN") communicator, a passive resonant unit used by stores as part of an anti-theft system in which transceiver 70 contains a resonant circuit that is blown or not-blown by an electronic signal at time of purchase of the item to which transceiver 70 is affixed, resonant sensors and transponders, and the like.

Further, since antennas according to the present invention can receive incoming radiation and coupled the same as alternating current into a cable, it will be appreciated that fractal antennas may be used to intercept incoming light radiation and to provide a corresponding alternating current. For example, a photocell antenna defining a fractal, or indeed a plurality or array of fractals, would be expected to output more current in response to incoming light than would a photocell of the same overall array size.

FIG. 5B depicts a fractal quad antenna 95, designed to resonant at the same frequency as the larger prior art antenna 5 shown in FIG. 5A. Driven element 100 is seen to be a second order fractal, here a so-called Minkowski island fractal, although any of numerous other fractal configurations could instead be used, including without limitation, Koch, torn square, Mandelbrot, Caley tree, monkey's swing, Sierpinski gasket, and Cantor gasket geometry.

If one were to measure to the amount of conductive wire or conductive trace comprising the perimeter of element 40, it would be perhaps 40% greater than the 1.0λ for the Euclidean quad of FIG. 5A. However, for fractal antenna 95, the physical straight length of one element side KS will be substantially smaller, and for the N=2 fractal antenna shown in FIG. 5B, KS≈0.13λ (in air), compared with K≈0.25λ for prior art antenna 5.

However, although the actual perimeter length of element 100 is greater than the 1λ perimeter of prior art element 10, the area within antenna element 100 is substantially less than the $S^2$ area of prior art element 10. As noted, this area independence from perimeter is a characteristic of a deterministic fractal. Boom length B for antenna 95 will be slightly different from length B for prior art antenna 5 shown in FIG. 4A. In FIG. 5B, a parasitic element 120, which preferably is similar to driven element 100 but need not be, may be attached to boom 130. For ease of illustration FIG. 5B does not depict non-conductive spreaders, such as spreaders 40 shown in FIG. 4A, which help hold element 100 together and element 120 together. Further, for ease of understanding the figure, element 10 is drawn with heavier lines than element 120, to avoid confusion in the portion of the figure in which elements 100 and 120 appear overlapped.

An impedance matching device 60 is advantageously unnecessary for the fractal antenna of FIG. 5B, as the driving impedance of element 100 is about 50Ω, e.g., a perfect match for cable 50 if reflector element 120 is absent, and about 35Ω, still an acceptable impedance match for cable 50, if element 120 is present. Antenna 95 may be fed by cable 50 essentially anywhere in element 100, e.g., including locations X, Y, Z, among others, with no substantial change in the termination impedance. With cable 50 connected as shown, antenna 95 will exhibit horizontal polarization. If vertical polarization is desired, connection may be made as shown by cable 50'. If desired, cables 50 and 50' may both be present, and an electronic switching device 75 at the antenna end of these cables can short-out one of the cables. If cable 50 is shorted out at the antenna, vertical polarization results, and if instead cable 50' is shorted out at the antenna, horizontal polarization results.

As shown by Table 3 herein, fractal quad 95 exhibits about 1.5 dB gain relative to Euclidean quad 10. Thus, transmitting power output. by transceiver 70 may be cut by perhaps 40% and yet the system of FIG. 5B will still perform no worse than the prior art system of FIG. 5A. Further, as shown by Table 1, the fractal antenna of FIG. 5B exhibits more resonance frequencies than the antenna of FIG. 5B, and also exhibits some resonant frequencies that are not harmonically related to each other. As shown by Table 3, antenna 95 has efficiency exceeding about 92% and exhibits an excellent SWR of about 1.2:1. As shown by Table 5, applicant's fractal quad antenna exhibits a relatively low value of Q. This result is surprising in view of conventional prior art wisdom to the effect that small loop antennas will exhibit high Q.

In short, that fractal quad 95 works at all is surprising in view of the prior art (mis)understanding as to the nature of radiation resistance R and ohmic losses O. Indeed, the prior art would predict that because the fractal antenna of FIG. 5B is smaller than the conventional antenna of FIG. 5A, efficiency would suffer due to an anticipated decrease in radiation resistance R. Further, it would have been expected that Q would be unduly high for a fractal quad antenna.

Figure 6:
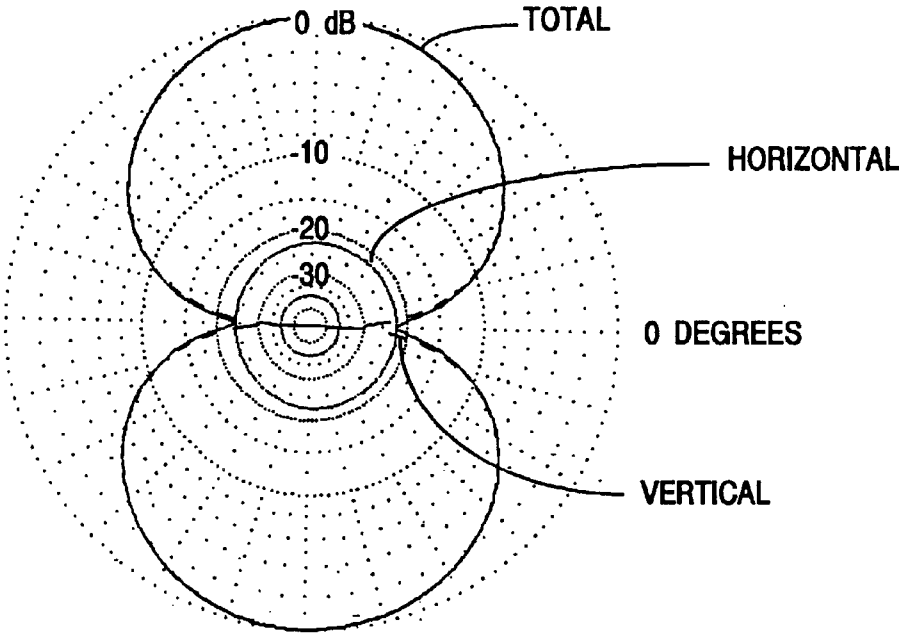
FIG. 6 depicts an ELNEC-generated free-space radiation pattern for an MI-2fractal antenna, according to the present invention.

FIG. 6 is an ELNEC-generated free-space radiation pattern for a second-iteration Minkowski fractal antenna, an antenna similar to what is shown in FIG. 5B with the parasitic element 120 omitted. The frequency of interest was 42.3 MHz, and a 1.5:1 SWR was used. In FIG. 6, the outer ring represents 2.091 dBi, and a maximum gain of 2.091 dBi. (ELNEC is a graphics/PC version of MININEC, which is a PC version of NEC.) In practice, however, the data shown in FIG. 6 were conservative in that a gain of 4.8 dB above an isotropic reference radiator was actually obtained. The error in the gain figures associated with FIG. 6 presumably is due to roundoff and other limitations inherent in the ELNEC program. Nonetheless, FIG. 6 is believed to accurately depict the relative gain radiation pattern of a single element Minkowski (MI-2) fractal quad according to the present invention.

Figure 7A:
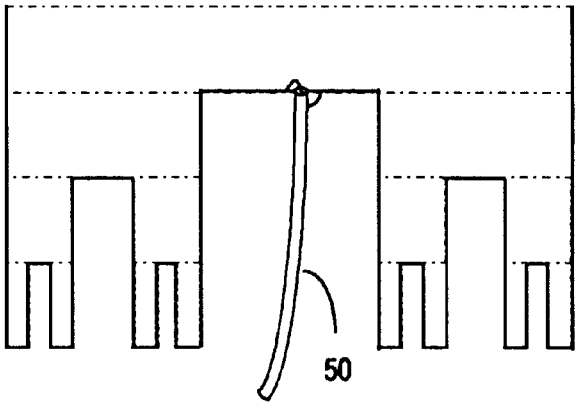
FIG. 7A depicts a Cantor-comb fractal dipole antenna, according to the present invention.
Figure 7B:
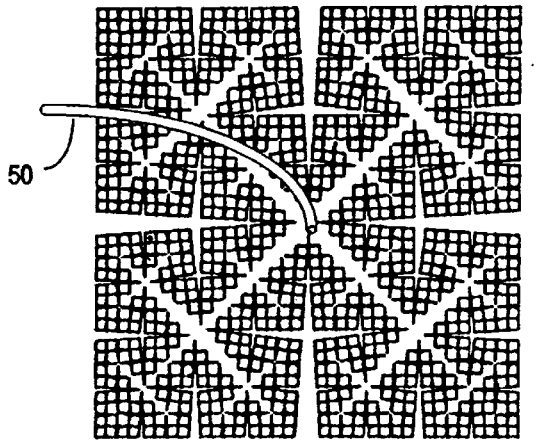
FIG. 7B depicts a torn square fractal quad antenna, according to the present invention.

FIG. 7A depicts a third iteration Cantor-comb fractal dipole antenna, according to the present invention. Generation of a Cantor-comb involves trisecting a basic shape, e.g., a rectangle, and providing a rectangle of one-third of the basic shape on the ends of the basic shape. The new smaller rectangles are then trisected, and the process repeated. FIG. 7B is modeled after the Lauwerier treatise, and depicts a single element torn-sheet fractal quad antenna.

As described later herein, the fractal element shown in FIG. 7B may be used as a ground counterpoise for an antenna system, for example, for a vertical antenna. In such application, the center conductor of cable 50 would be coupled to the lower end of the vertical antenna element (not shown, but which itself may be a fractal), and the ground shield of cable 50 would be coupled to the fractal element shown in FIG. 7B. The fractal ground poise may be substantially smaller than a conventional 0.25λ ground system, without detriment to gain, coupling impedance, and vertical polarization characteristics of the antenna system.

Figures 1, 7C:
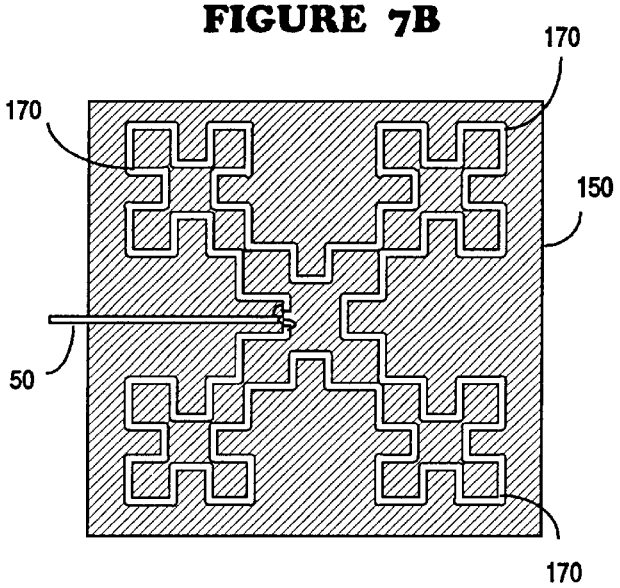
FIG. 7C-1 depicts a second iteration Minkowski (MI-2) printed circuit fractal antenna, according to the present invention.

FIG. 7C-1 depicts a printed circuit antenna, in which the antenna is fabricated using printed circuit or semiconductor fabrication techniques. For ease of understanding, the etched-away non-conductive portion of the printed circuit board 150 is shown cross-hatched, and the copper or other conductive traces 170 are shown without cross-hatching.

Applicant notes that while various corners of the Minkowski rectangle motif may appear to be touching in this and perhaps other figures herein, in fact no touching occurs. Further, it is understood that it suffices if an element according to the present invention is substantially a fractal. By this it is meant that a deviation of less than perhaps 10% from a perfectly drawn and implemented fractal will still provide adequate fractal-like performance, based upon actual measurements conducted by applicant.

The substrate 150 is covered by a conductive layer of material 170 that is etched away or otherwise removed in areas other than the fractal design, to expose the substrate 150. The remaining conductive trace portion 170 defines a fractal antenna, a second iteration Minkowski slot antenna in FIG. 7C-1. Substrate 150 may be a silicon wafer, a rigid or a flexible plastic-like material, perhaps Mylar™ material, or the non-conductive portion of a printed circuit board. Overlayer 170 may be deposited doped polysilicon for a semiconductor substrate 150, or copper for a printed circuit board substrate.

If desired, the fractal structure shown in FIG. 7C-1 could be utilized as a fractal ground counterpoise for an antenna system, for example a vertical antenna. The fractal ground counterpoise may be fabricated using smaller dimensions than a conventional prior art system employing typically 0.25λ ground radials or elements. If the structure shown in FIG. 7C-1 is used as a ground counterpoise, the center lead of cable 50 would be coupled to the vertical element (not shown), and the ground shield would be coupled to the fractal structure shown.

Figures 2, 7C:
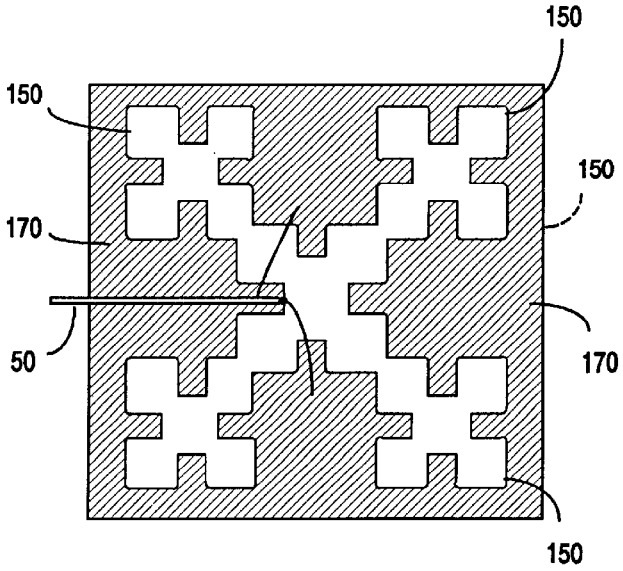

FIG. 7C-2 depicts a slot antenna version of what was shown in FIG. 7C-2, wherein the conductive portion 170 (shown cross-hatched in FIG. 7C-2) surrounds and defines a fractal-shape of non-conductive substrate 150. Electrical connection to the slot antenna is made with a coaxial or other cable 50, whose inner and outer conductors make contact as shown.

In FIGS. 7C-1 and 7C-2, the substrate or plastic-like material in such constructions can contribute a dielectric effect that may alter somewhat the performance of a fractal antenna by reducing resonant frequency, which increases perimeter compression PC.

Those skilled in the art will appreciate that by virtue of the relatively large amount of conducting material (as contrasted to a thin wire), antenna efficiency is promoted in a slot configuration. Of course a printed circuit board or substrate-type construction could be used to implement a non-slot fractal antenna, e.g, in which the fractal motif is fabricated as a conductive trace and the remainder of the conductive material is etched away or otherwise removed. Thus, in FIG. 7C, if the cross-hatched surface now represents non-conductive material, and the non-cross hatched material represents conductive material, a printed circuit board or substrate-implemented wire-type fractal antenna results.

Printed circuit board and/or substrate-implemented fractal antennas are especially useful at frequencies of 80 MHz or higher, whereat fractal dimensions indeed become small. A 2 M MI-3 fractal antenna (e.g., FIG. 7E) will measure about 5.5" (14 cm) on a side KS, and an MI-2 fractal antenna (e.g., FIG. 5B) will about 7" (17.5 cm) per side KS. As will be seen from FIG. 8A, an MI-3 antenna suffers a slight loss in gain relative to an MI-2 antenna, but offers substantial size reduction.

Applicant has fabricated an MI-2 Minkowski island fractal antenna for operation in the 850–900 MHz cellular telephone band. The antenna was fabricated on a printed circuit board and measured about 1.2" (3 cm) on a side KS. The antenna was sufficiently small to fit inside applicant's cellular telephone, and performed as well as if the normal attachable "rubber-ducky" whip antenna were still attached. The antenna was found on the side to obtain desired vertical polarization, but could be fed anywhere on the element with 50Ω impedance still being inherently present. Applicant also fabricated on a printed circuit board an MI-3 Minkowski island fractal quad, whose side dimension KS was about 0.8" (2 cm), the antenna again being inserted inside the cellular telephone. The MI-3 antenna appeared to work as well as the normal whip antenna, which was not attached. Again, any slight gain loss in going from MI-2 to MI-3 (e.g., perhaps 1 dB loss relative to an MI-0 reference quad, or 3 dB los relative to an MI-2) is more than offset by the resultant shrinkage in size. At satellite telephone frequencies of 1650 MHz or so, the dimensions would be approximated halved again. FIGS. 8A, 8B and 8C depict preferred embodiments for such antennas. FIG. 7D depicts a 2M dendrite deterministic fractal antenna that includes a slight amount of randomness. The vertical arrays of numbers depict wavelengths relative to 0λ, at the lower end of the trunk-like element 200. Eight radial-like elements 210 are disposed at 1.0λ, and various other elements are disposed vertically in a plane along the length of element 200. The antenna was fabricated using 12 gauge copper wire and was found to exhibit a surprising 20 dBi gain, which is at least 10 dB better than any antenna twice the size of what is shown in FIG. 7D. Although superficially the vertical of FIG. 7D may appear analogous to a log-periodic antenna, a fractal vertical according to the present invention does not rely upon an opening angle, in stark contrast to prior art log periodic designs.

Figure 7E:
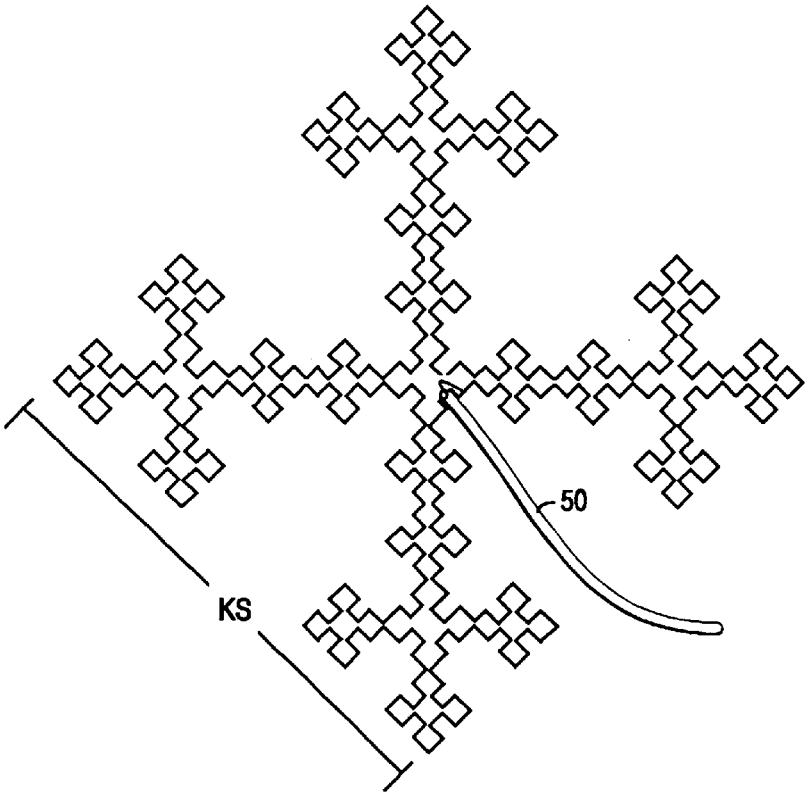
FIG. 7E depicts a third iteration Minkowski island (MI-3) fractal quad antenna, according to the present invention.
Figure 7D:
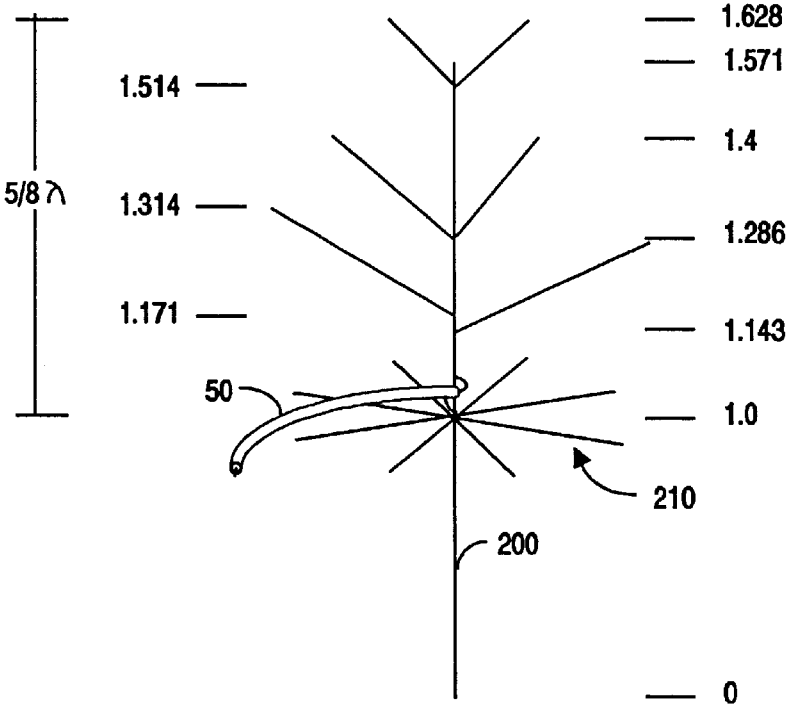
FIG. 7D depicts a deterministic dendrite fractal vertical antenna, according to the present invention.
Figures 1A, 7D:
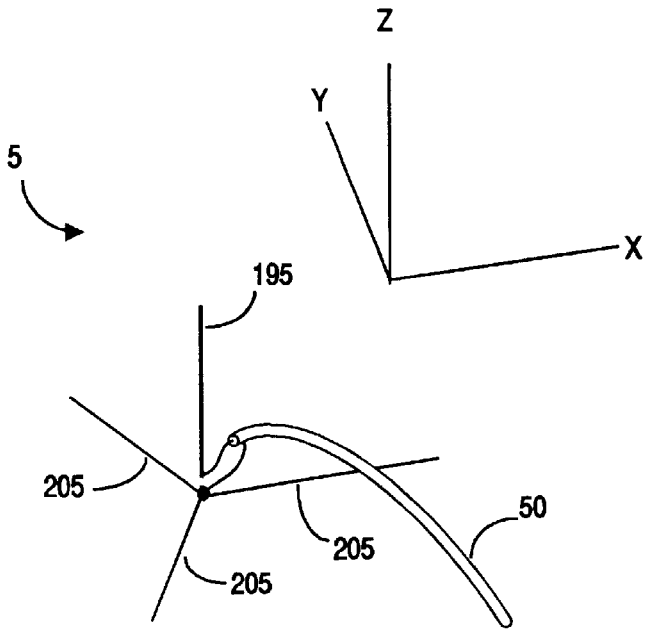
FIGURE 7D-1A (PRIOR ART)
FIG. 1A depicts a base element for an antenna or an inductor, according to the prior art.
Figures 1B, 7D:
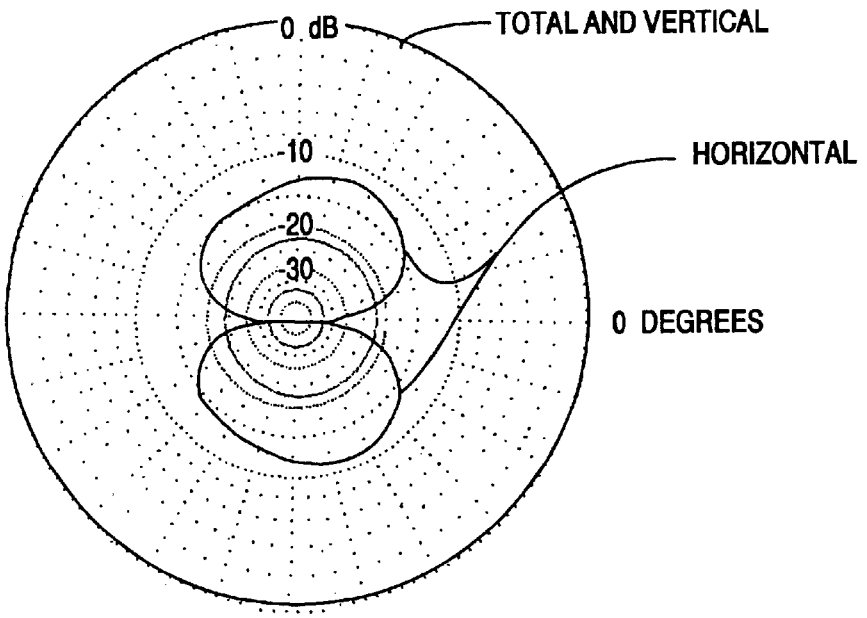
FIG. 1B depicts a triangular-shaped Koch fractal motif, according to the prior art.
Figure 8A:
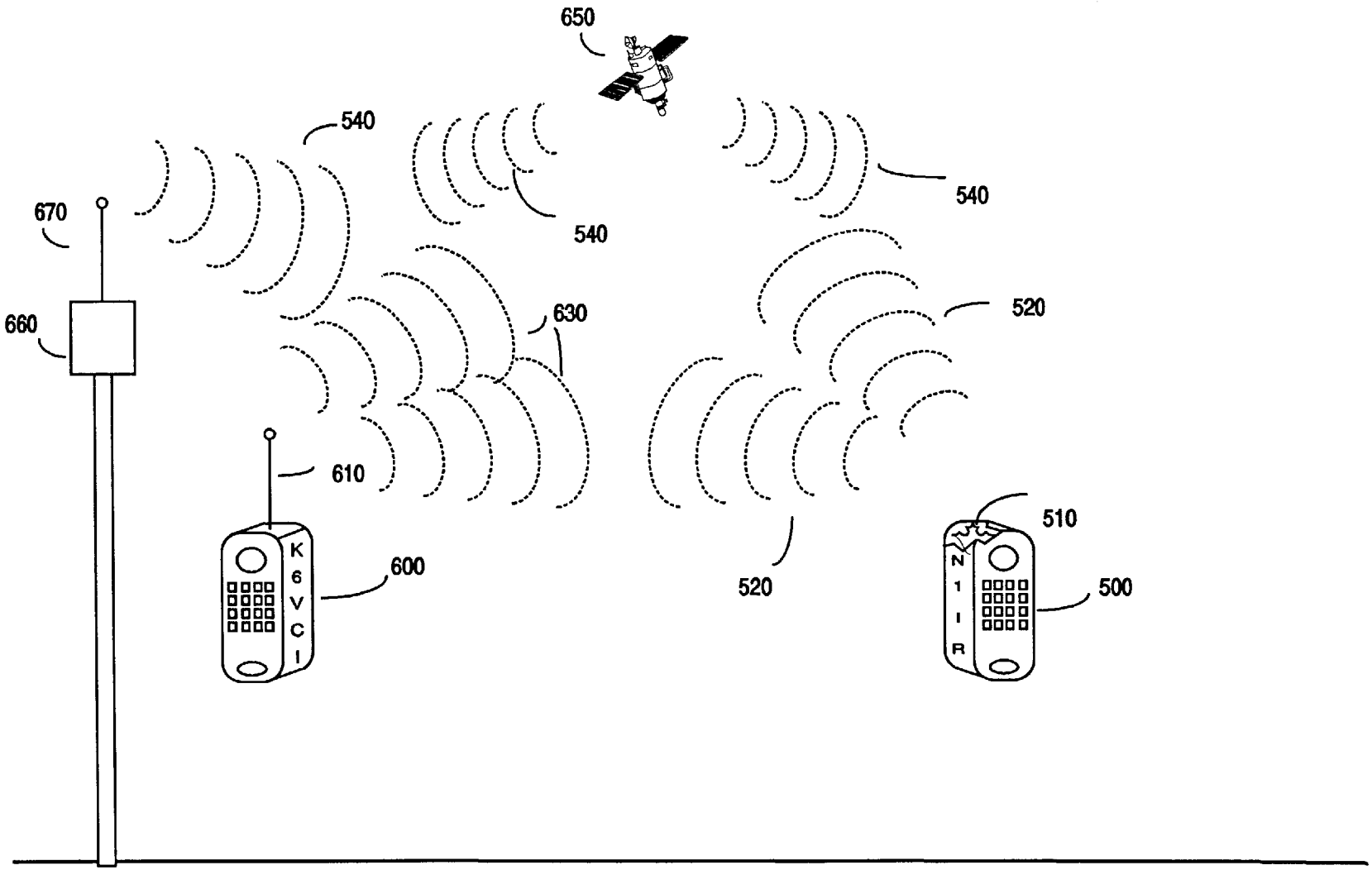
FIG. 8A depicts a generic system in which a passive or active electronic system communicates using a fractal antenna, according to the present invention.
Figure 8B:
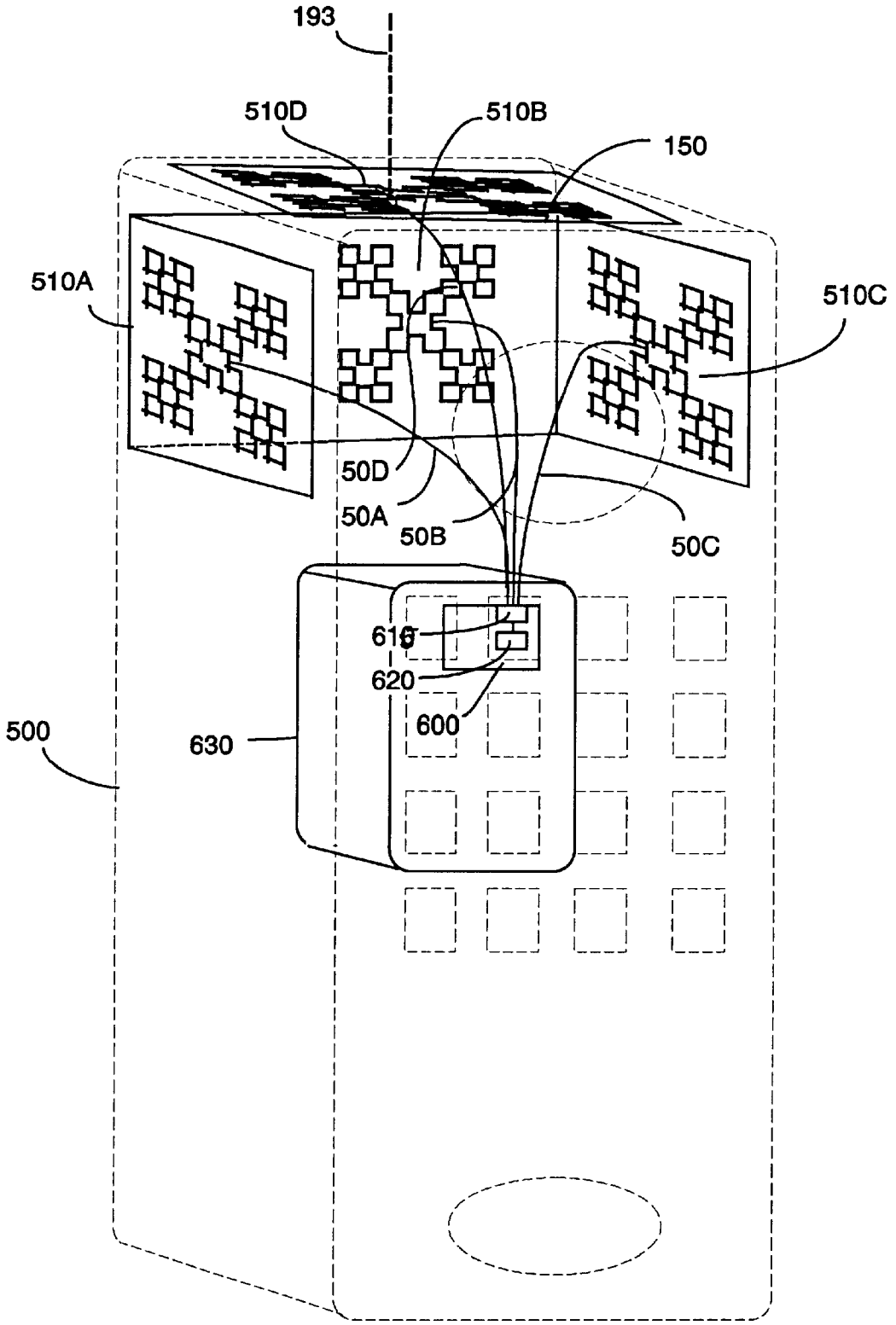
FIG. 8B depicts a communication system in which several fractal antennas including a vertical antenna with a fractal ground counterpoise are electronically selected for best performance, according to the present invention.
Figure 8C:
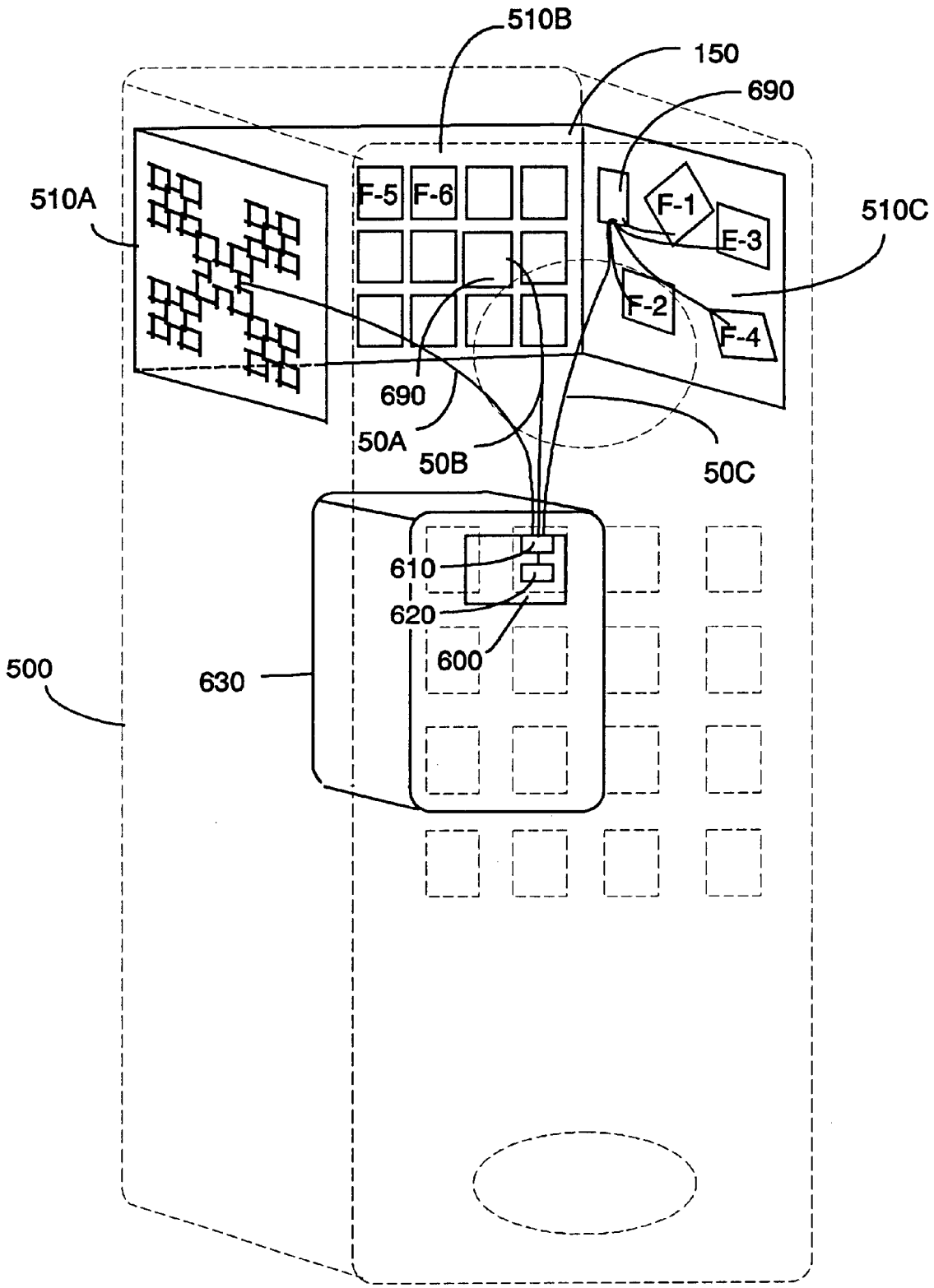
FIG. 8C depicts a communication system in which electronically steerable arrays of fractal antennas are electronically selected for best performance, according to the present invention.

FIGS. 7D-1A and 7D-1B depict a conventional vertical antenna 5, comprising a 0.25λ long vertical element 195, and three 0.25λ long ground plane radials 205. Antenna 5 is fed using coaxial cable 50 in conventional fashion, the antenna impedance being on the order of about 240Ω. Antenna efficiency may be improved by adding additional radial elements 205, however doing so frequently requires more space than is conveniently available. In other configurations, a ground plane or counterpoise may be used without radials, e.g., earth or the metal body of an automobile in the case of a vehicular-mounted antenna. The 0° elevation angle azimuth plot of FIG. 7D-1B depicts the undesirably large horizontal polarization components (the "figure eight" pattern) exhibited by this prior art vertical system, with vertical and total gain being about 1.45 dBi.

Figures 2A, 7D:
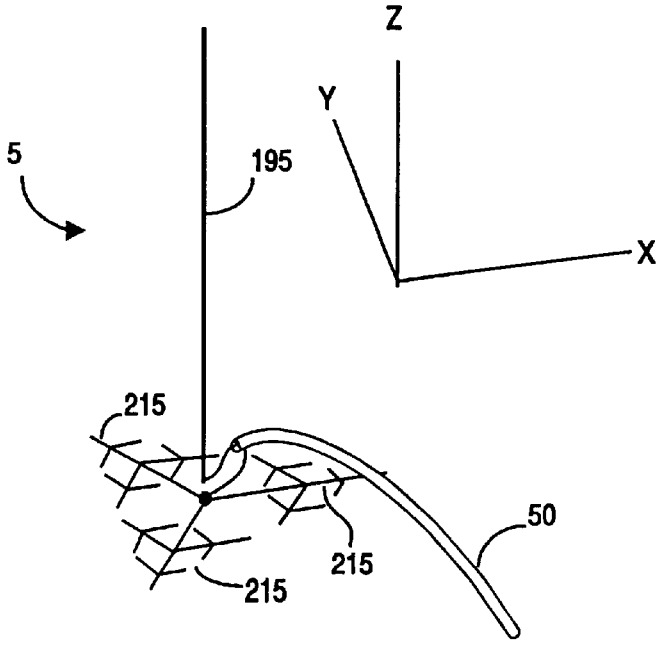
FIG. 2A depicts a base element for an antenna or an inductor, according to the prior art.

FIG. 7D-2A depicts an antenna system 5 according to the present invention as including a vertical element 195 and a fractalized ground counterpoise system comprising, in this example, three dendrite fractal ground radials 215. The ground radials are coupled to the ground shield on cable 50, whereas the center lead of cable 50 is coupled to the vertical element 195. Of course, other fractal configurations may be used instead, and a different number of ground radials may also be used.

Figures 2B, 7D:
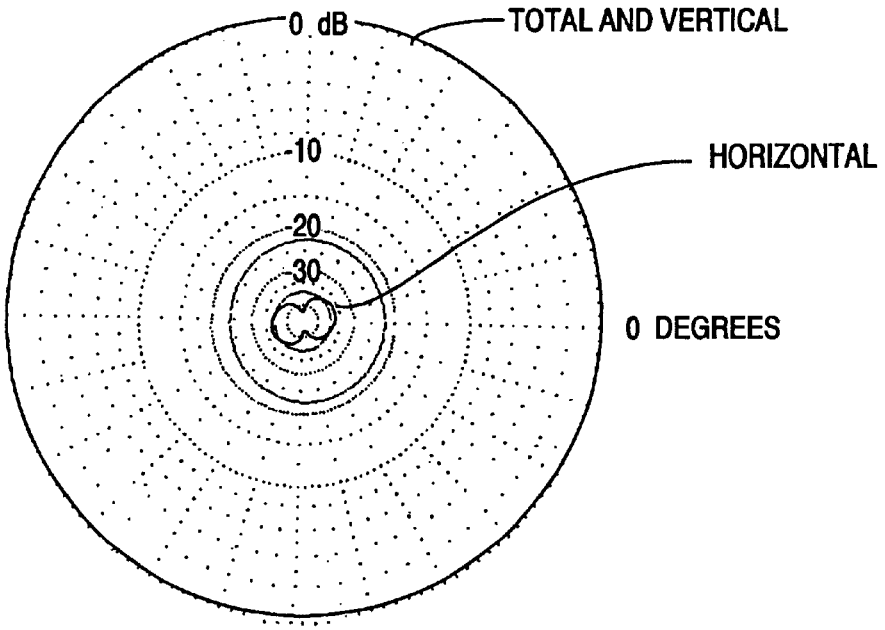
FIG. 2B depicts a rectangular-shaped Minkowski fractal motif, according to the prior art.

In the azimuth plot of FIG. 7D-2B, the elevation angle is 0°, and each fractal ground radial element is only about 0.087λ. The maximum gain, at the outermost ring in the figure, is 1.83 dBi and the input impedance is about 300Ω. Note in FIG. 7D-2B that relatively little energy is radiated horizontally, and nearly all of the energy is radiated vertically, a desirable characteristic for a vertical antenna. It will be appreciated that the 0.087λ dimensions of fractal ground plane elements 215 are substantially physically smaller than the 0.25λ elements 205 in the prior art system of FIG. 7D-1A. However, the radiation pattern for the system of FIG. 7D-2A is actually better than that of the larger prior art system.

Figures 3A, 7D:
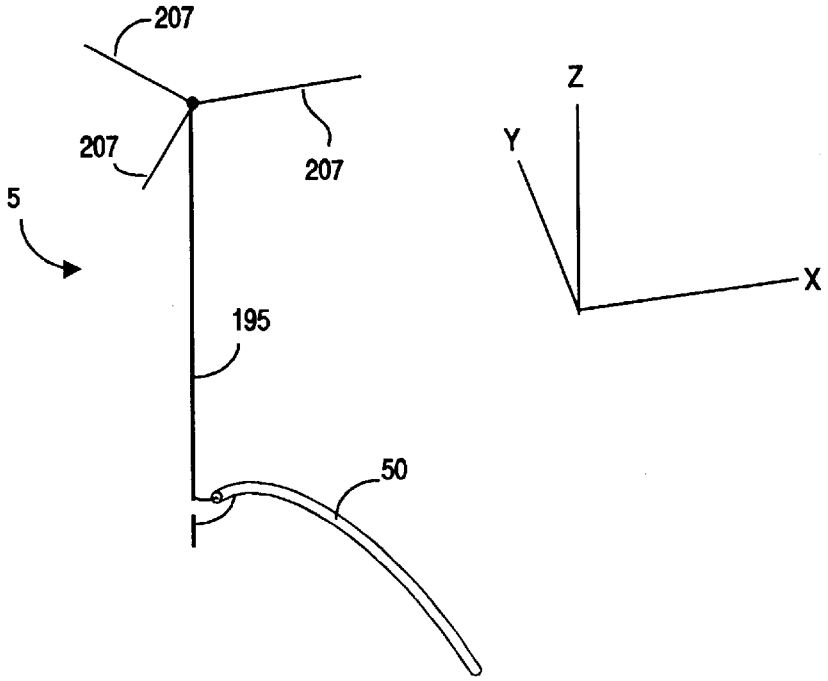
FIGURE 7D-3A (PRIOR ART)
Figures 3B, 7D:
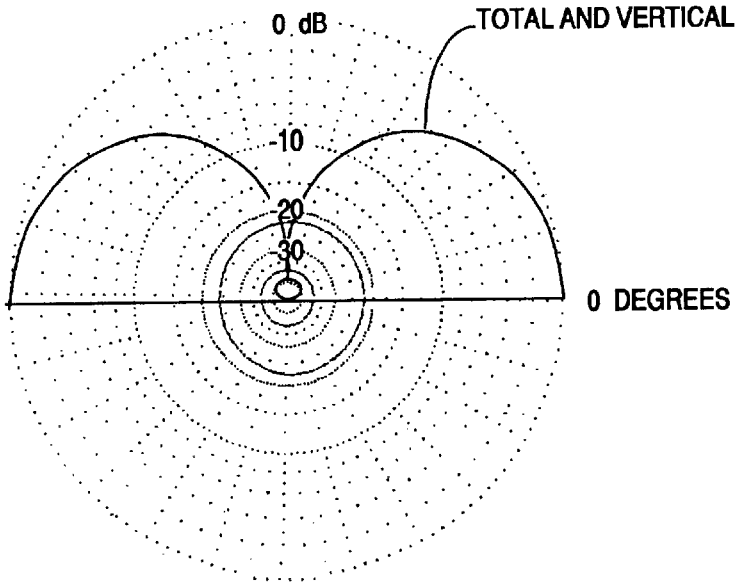
FIGURE 7D-3B (PRIOR ART)
Figures 4A, 7D:
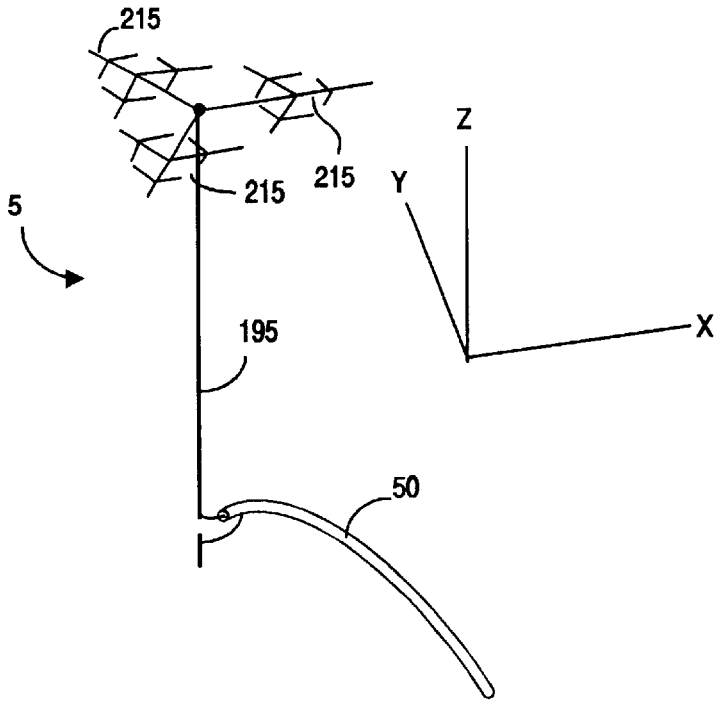
Figures 4B, 7D:
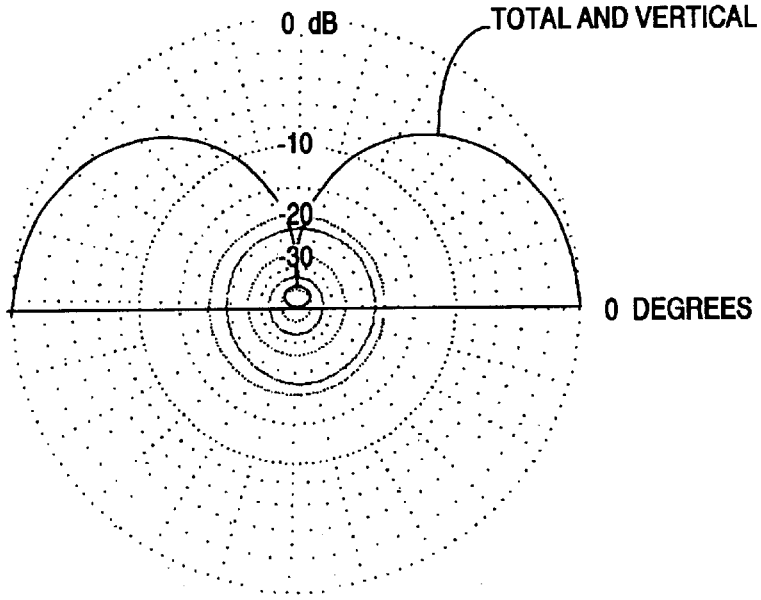

FIG. 7D-3A depicts a so-called "top-hat" loaded vertical antenna 5, according to the prior art. Antenna 5 includes a vertical element 195 and, in the example shown, a top-hat assembly comprising three spokes 207 located at the antenna top. The antenna is fed in conventional fashion with coaxial cable 50. FIG. 7D-3B depicts the radiation pattern for the conventional top-hat loaded antenna of FIG. 7D-3A.

Figure 4A:
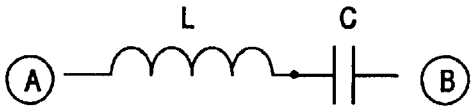
FIGURE 4A (PRIOR ART)
FIG. 4A depicts a series L-C resonator, according to the prior art.

FIG. 7D-4A depicts a "top-hat" antenna 5 that includes a vertical element 195 whose top is loaded by a top-hat assembly including fractalized radial spokes 215. Antenna 5 may be fed in conventional fashion by coaxial cable 50. For the same vertical length of element 195 as was used in FIG. 7D-3A, the use of fractal radial spokes 215 advantageously decreases resonant frequency by 20%. In addition, the size of the "top-hat" assembly may be reduced by about 20%, and the area required for the "top-hat" assembly may be reduced by about 35%. These reductions are advantageous in that the fractalized top-hat antenna of FIG. 7D-4A can require less material to fabricate, thus reducing manufacturing cost, weight, and wind resistance, relative to a prior art top-hat configuration. According to the present invention, it suffices if at least one of the elements in the top-hat assembly has a physical shaped defined at least in part by a fractal. Of course, more or less than three spokes may be used, and other fractal configurations may also be used, including combinations of fractal and non-fractal elements, as well as different types of fractal elements.

Figure 4B:
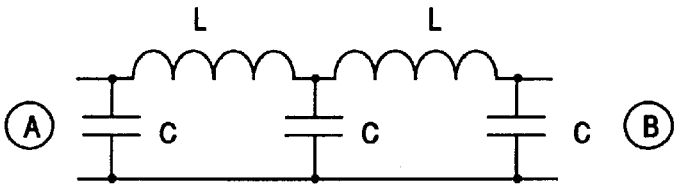
FIGURE 4B (PRIOR ART)
FIG. 4B depicts a distributed parallel L-C resonator, according to the prior art.

FIG. 7D-4B represents the radiation pattern for the fractalized top-hat antenna of FIG. 7D-4A. A comparison of FIGS. 7D-4B and 7D-3B confirms that there is no real performance penalty associated with using the fractalized configuration. Thus, the above-noted savings in cost, weight, and wind resistance are essentially penalty free.

Figures 5, 7D:
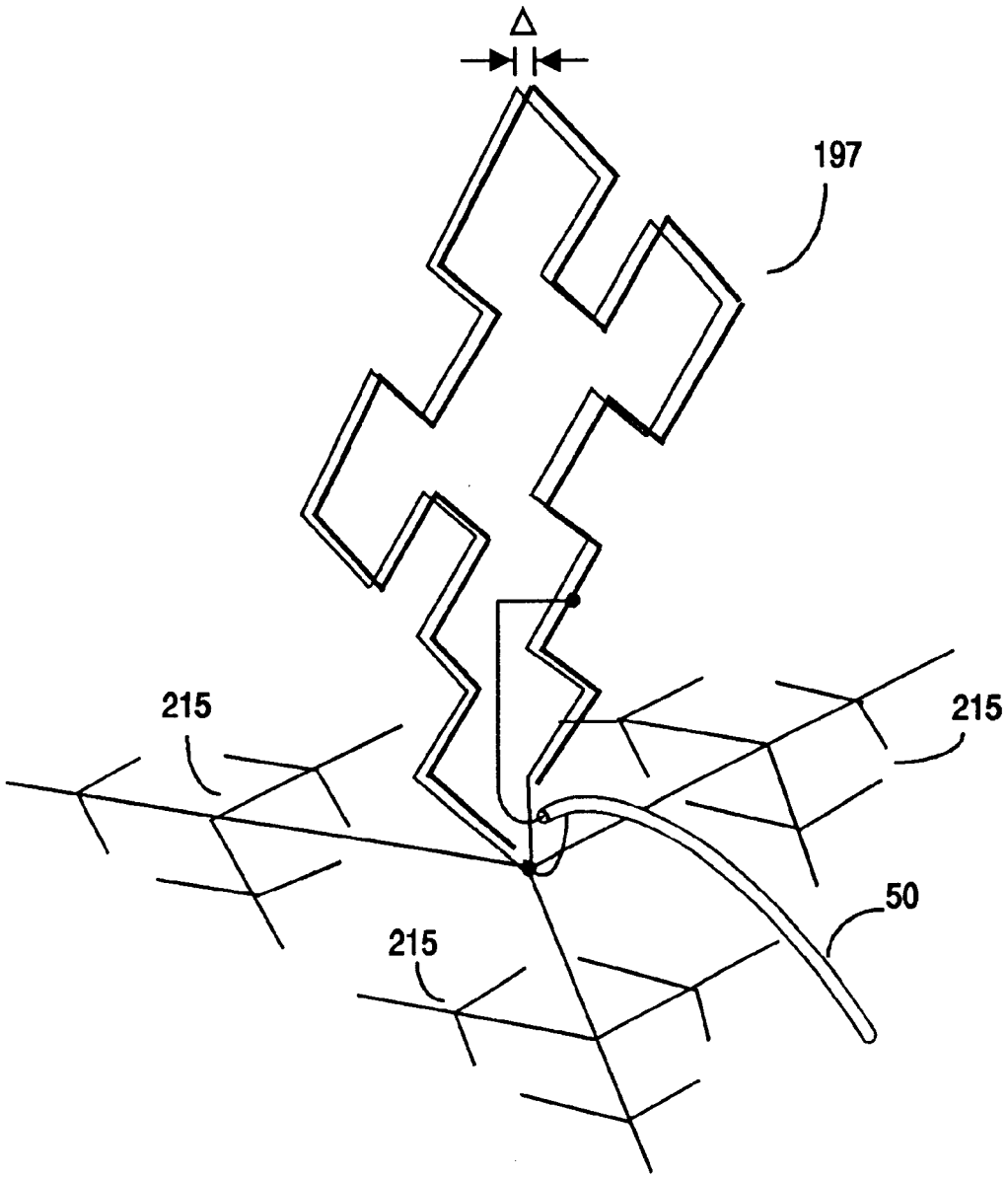

FIG. 7D-5 depicts an antenna system according to the present invention, in which fractal ground elements 215 and a fractal vertical element 197 are both used. Fractal antenna elements 215 are preferably about 0.087λ, and element 197 is about λ/12. Fractal vertical element 197 preferably comprises a pair of spaced-apart elements such as generally described with respect to FIGS. 11A, 12A, 12B, 13B, 14A, 14B, and 14C. It is to be understood, however, that the salient feature of element 197 in FIG. 7D-3 is not its specific shape, but rather that it defines a fractal, and preferably a pair of spaced-apart fractal elements. It is solely for ease of illustration that the fractal elements shown in FIGS. 7D-3, 11A, 12A, 12B, 13B, 14A, 14B, 14C, and 14D are similarly drawn. Further, the fractal-fractal antenna system shown in FIG. 7D-3 is preferably tuned by varying the spaced-apart distance A, and/or by rotating the spaced-apart elements relative to one another, and/or by forming a "cut" in an element, as described hereinafter with respect to various of FIGS. 11A, 12A, 12B, 13B, 14A, 14B, 14C and 14D.

FIG. 7E depicts a third iteration Minkowski island quad antenna (denoted herein as MI-3). The orthogonal line segments associated with the rectangular Minkowski motif make this configuration especially acceptable to numerical study using ELNEC and other numerical tools using moments for estimating power patterns, among other modeling schemes. In testing various fractal antennas, applicant formed the opinion that the right angles present in the Minkowski motif are especially suitable for electromagnetic frequencies.

With respect to the MI-3 fractal of FIG. 7E, applicant discovered that the antenna becomes a vertical if the center led of coaxial cable 50 is connected anywhere to the fractal, but the outer coaxial braid-shield is left unconnected at the antenna end. (At the transceiver end, the outer shield is connected to ground.) Not only do fractal antenna islands perform as vertical antennas when the center conductor of cable 50 is attached to but one side of the island and the braid is left ungrounded at the antenna, but resonance frequencies for the antenna so coupled are substantially reduced. For example, a 2" (5 cm) sized MI-3 fractal antenna resonated at 70 MHz when so coupled, which is equivalent to a perimeter compression PC≈20.

Figure 7F:
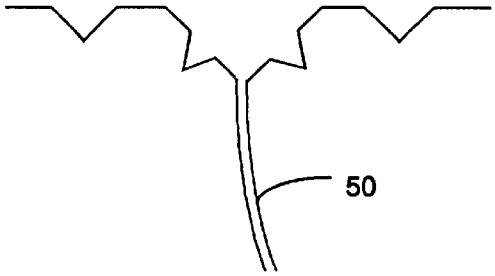
FIG. 7F depicts a second iteration Koch fractal dipole, according to the present invention.
Figure 7G:
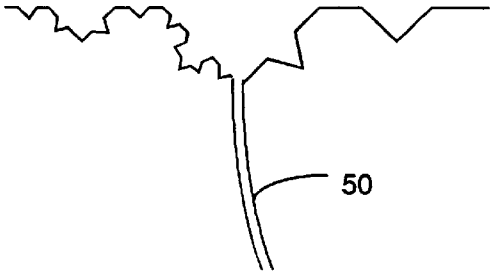
FIG. 7G depicts a third iteration dipole, according to the present invention.
Figure 7H:
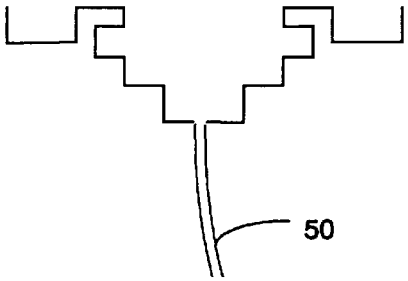
FIG. 7H depicts a second iteration Minkowski fractal dipole, according to the present invention.
Figure 7I:
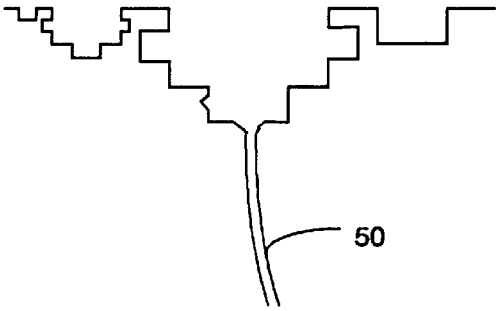
FIG. 7I depicts a third iteration multi-fractal dipole, according to the present invention.

FIG. 7F depicts a second iteration Koch fractal dipole, and FIG. 7G a third iteration dipole. FIG. 7H depicts a second iteration Minkowski fractal dipole, and FIG. 71 a third iteration multi-fractal dipole. Depending upon the frequencies of interest, these antennas may be fabricated by bending wire, or by etching or otherwise forming traces on a substrate. Each of these dipoles provides substantially 50Ω termination impedance to which coaxial cable 50 may be directly coupled without any impedance matching device. It is understood in these figures that the center conductor of cable 50 is attached to one side of the fractal dipole, and the braid outer shield to the other side.

A fractal ground counterpoise may be fabricated using fractal element as shown in any (or all) of FIGS. 7E-7I. Thus, in FIGS. 7D-2A and 7D-3, fractal ground radial elements 215 are understood to depict any fractal of iteration order N≧1. Further, such fractals may, but need not be, defined by an opening angle.

FIG. 8A depicts a generalized system in which a transceiver 500 is coupled to a fractal antenna system 510 to send electromagnetic radiation 520 and/or receive electromagnetic radiation 540. A second transceiver 600 shown equipped with a conventional whip-like vertical antenna 610 also sends electromagnetic energy 630 and/or receives electromagnetic energy 540.

Fractal antenna system 510 may include a fractal ground counterpoise and/or fractal antenna element, as described earlier herein, and/or a microstrip patch antenna with fractal structure, as described later herein. As noted in the case of a vertical antenna element, the overall size of the resulting antenna system is substantially smaller than what may be achieved with a prior art ground counterpoise system. Further, the fractal ground counterpoise system may be fabricated on a flexible substrate that is rolled, curved, or otherwise formed to fit within a case such as contains transceiver 500. The resultant antenna ground system exhibits improved efficiency and power distribution pattern relative to a prior art system that may somehow be fit into an equivalent amount of area.

If transceivers 500, 600 are communication devices such as transmitter-receivers, wireless telephones, pagers, or the like, a communications repeating unit such as a satellite 650 and/or a ground base repeater unit 660 coupled to an antenna 670, or indeed to a fractal antenna according to the present invention, may be present.

Alternatively, antenna 510 in transceiver 500 could be a passive LC resonator fabricated on an integrated circuit microchip, or other similarly small sized substrate, attached to a valuable item to be protected. Configurations such as shown in exemplary FIGS. 16–18 may also be fabricated for antenna 510, according to the present invention. Transceiver 600, or indeed unit 660 would then be an electromagnetic transmitter outputting energy at the frequency of resonance, a unit typically located near the cash register checkout area of a store or at an exit. Depending upon whether fractal antenna-resonator 510 is designed to "blow" (e.g., become open circuit) or to "short" (e.g., become a close circuit) in the transceiver 500 will or will not reflect back electromagnetic energy 540 or 6300 to a receiver associated with transceiver 600. In this fashion, the unauthorized relocation of antenna 510 and/or transceiver 500 can be signaled by transceiver 600.

FIG. 8B depicts a transceiver 500 equipped with a plurality of fractal antennas, here shown as 510A, 510B, 510C and 510D coupled by respective cables 50A, 50B, 50C, 50D to electronics 600 within unit 500. In the embodiment shown, one of more of these antenna elements is are fabricated on a conformal, flexible substrate 150, e.g., Mylar™ material or the like, upon which the antennas per se may be implemented by printing fractal patterns using conductive ink, by copper deposition, among other methods including printed circuit board and semiconductor fabrication techniques. A flexible such substrate may be conformed to a rectangular, cylindrical or other shape as necessary.

In the embodiment of FIG. 8B, unit 500 is a handheld transceiver, and antennas 510A, 510B, 510C, 510D preferably are fed for vertical polarization, as shown. Element 510D may, for example, be a fractal ground counterpoise system for a vertical antenna element, shown in phantom as element 193 (which element may itself be a fractal to further reduce dimensions).

An electronic circuit 610 is coupled by cables 50A, 50B, 50C to the antennas, and samples incoming signals to discern which fractal antenna system, e.g., 510A, 510B, 510C, 510D is presently most optimally aligned with the transmitting station, perhaps a unit 600 or 650 or 670 as shown in FIG. 8A. This determination may be made by examining signal strength from each of the antennas. An electronic circuit 620 then selects the presently best oriented antenna, and couples such antenna to the input of the receiver and output of the transmitter portion, collectively 630, of unit 500. It is understood that the selection of the best antenna is dynamic and can change as, for example, a user of 500 perhaps walks about holding the unit, or the transmitting source moves, or due to other changing conditions. In a cellular or a wireless telephone application, the result is more reliable communication, with the advantage that the fractal antennas can be sufficiently small-sized as to fit totally within the casing of unit 500. Further, if a flexible substrate is used, the antennas may be wrapped about portions of the internal casing, as shown.

An additional advantage of the embodiment of FIG. 8B is that the user of unit 500 may be physically distanced from the antennas by a greater distance that if a conventional external whip antenna were used. Although medical evidence attempting to link cancer with exposure to electromagnetic radiation from handheld transceivers is still inconclusive, the embodiment of FIG. 8B appears to minimize any such risk. Although FIG. 8B depicts a vertical antenna 193 and a fractal ground counterpoise 510D, it is understood that antenna 193 could represent a cellular antenna on a motor vehicle, the ground poise for which is fractal unit 510D. Further, as noted, vertical element 193 may itself be a fractal.

FIG. 8C depicts yet another embodiment wherein some or all of the antenna systems 510A, 510B, 510C may include electronically steerable arrays, including arrays of fractal antennas of differing sizes and polarization orientations. Antenna system 510C, for example may include similarly designed fractal antennas, e.g., antenna F-3 and F-4, which are differently oriented from each other. Other antennas within system 510C may be different in design from either of F-3, F-4. Fractal antenna F-1 may be a dipole for example. Leads from the various antennas in system 510C may be coupled to an integrated circuit 690, mounted on substrate 150. Circuit 690 can determine relative optimum choice between the antennas comprising system 510C, and output via cable 50C to electronics 600 associated with the transmitter and/or receiver portion 630 of unit 630. Of course, the embodiment of FIG. 8C could also include the vertical antenna element 193 and fractal ground counterpoise 510D, depicted in FIG. 8B.

Another antenna system 510B may include a steerable array of identical fractal antennas, including fractal antenna F-5 and F-6. An integrated circuit 690 is coupled to each of the antennas in the array, and dynamically selects the best antenna for signal strength and coupled such antenna via cable 50B to electronics 600. A third antenna system 510A may be different from or identical to either of system 510B and 510C.

Although FIG. 8C depicts a unit 500 that may be handheld, unit 500 could in fact be a communications system for use on a desk or a field mountable unit, perhaps unit 660 as shown in FIG. 8A.

For ease of antenna matching to a transceiver load, resonance of a fractal antenna was defined as a total impedance falling between about 20Ω to 200Ω, and the antenna was required to exhibit medium to high Ω, e.g., frequency/frequency. In practice, applicants'various fractal antennas were found to resonate in at least one position of the antenna feedpoint, e.g., the point at which coupling was made to the antenna. Further, multi-iteration fractals according to the present invention were found to resonate at multiple frequencies, including frequencies that were non-harmonically related.

Contrary to conventional wisdom, applicant found that island-shaped fractals (e.g., a closed loop-like configuration) do not exhibit significant drops in radiation resistance R for decreasing antenna size. As described herein, fractal antennas were constructed with dimensions of less than 12" across (30.48 cm) and yet resonated in a desired 60MHz to 100 MHz frequency band.

Applicant further discovered that antenna perimeters do not correspond to lengths that would be anticipated from measured resonant frequencies, with actual lengths being longer than expected. This increase in element length appears to be a property of fractals as radiators, and not a result of geometric construction. A similar lengthening effect was reported by Pfeiffer when constructing a full-sized quad antenna using a first order fractal, see A. Pfeiffer, *The Pfeiffer Quad Antenna System*, QST, p. 28–32 (March 1994).

If L is the total initial one-dimensional length of a fractal pre-motif application, and r is the one-dimensional length post-motif application, the resultant fractal dimension D (actually a ratio limit) is:

$$D32\ \log(L)/\log(r)$$

With reference to FIG. 1A, for example, the length of FIG. 1A represents L, whereas the sum of the four line segments comprising the Koch fractal of FIG. 1B represents r.

Unlike mathematical fractals, fractal antennas are not characterized solely by the ratio D. In practice D is not a good predictor of how much smaller a fractal design antenna may be because D does not incorporate the perimeter lengthening of an antenna radiating element.

Because D is not an especially useful predictive parameter in fractal antenna design, a new parameter "perimeter compression" ("PC") shall be used, where:

$$PC = \frac{\text{full-sized antenna element length}}{\text{fractal-reduced antenna element length}}$$

In the above equation, measurements are made at the fractal-resonating element's lowest resonant frequency. Thus, for a full-sized antenna according to the prior art PC=1, while PC=3 represents a fractal antenna according to the present invention, in which an element side has been reduced by a factor of three.

Perimeter compression may be empirically represented using the fractal dimension D as follows:

$$PC = A \cdot \log[N(D+C)]$$

where A and C are constant coefficients for a given fractal motif, N is an iteration number, and D is the fractal dimension, defined above.

It is seen that for each fractal, PC becomes asymptotic to a real number and yet does not approach infinity even as the iteration number N becomes very large. Stated differently, the PC of a fractal radiator asymptotically approaches a non-infinite limit in a finite number of fractal iterations. This result is not a representation of a purely geometric fractal.

That some fractals are better resonating elements than other fractals follows because optimized fractal antennas approach their asymptotic PCs in fewer iterations than non-optimized fractal antennas. Thus, better fractals for antennas will have large values for A and C, and will provide the greatest and most rapid element-size shrinkage. Fractal used may be deterministic or chaotic. Deterministic fractals have a motif that replicates at a 100% level on all size scales, whereas chaotic fractals include a random noise component.

Applicant found that radiation resistance of a fractal antenna decreases as a small power of the perimeter compression (PC), with a fractal island always exhibiting a substantially higher radiation resistance than a small Euclidean loop antenna of equal size.

Further, it appears that the number of resonant nodes of a fractal island increase as the iteration number (N) and is always greater than or equal to the number of resonant nodes of an Euclidean island with the same area. Finally, it appears that a fractal resonator has an increased effective wavelength.

The above findings will now be applied to experiments conducted by applicant with fractal resonators shaped into closed-loops or islands. Prior art antenna analysis would predict no resonance points, but as shown below, such is not the case.

A Minkowski motif is depicted in FIGS. 2B-2D, 5B, 7C and 7E. The Minkowski motif selected was a three-sided box (e.g., 20-2 in FIG. 2B) placed atop a line segment. The box sides may be any arbitrary length, e.g, perhaps a box height and width of 2 units with the two remaining base sides being of length three units (see FIG. 2B). For such a configuration, the fractal dimension D is as follows:

$$D = \frac{\log(L)}{\log(r)} = \frac{\log(12)}{\log(8)} = \frac{1.08}{0.90} = 1.20$$

It will be appreciated that D=1.2 is not especially high when compared to other deterministic fractals.

Applying the motif to the line segment may be most simply expressed by a piecewise function f(x) as follows:

$$f(x) = \begin{cases} 0 & 0 \geq x \geq \frac{3x_{max}}{8} \\ \frac{1}{4x_{max}} & \frac{3x_{max}}{8} \geq x \geq \frac{5x_{max}}{8} \\ 0 & \frac{5x_{max}}{8} \geq x \geq x_{max} \end{cases}$$

where $x_{max}$ is the largest continuous value of x on the line segment.

A second iteration may be expressed as $f(x)_2$ relative to the first iteration $f(x)_1$ by:

$$f(x)_2 = f(x)_1 + f(x)$$

where $x_{max}$ is defined in the above-noted piecewise function. Note that each separate horizontal line segment will have a different lower value of x and $x_{max}$. Relevant offsets from zero may be entered as needed, and vertical segments may be "boxed" by 90° rotation and application of the above methodology.

As shown by FIGS. 5B and 7E, a Minkowski fractal quickly begins to appear like a Moorish design pattern. However, each successive iteration consumes more perimeter, thus reducing the overall length of an orthogonal line segment. Four box or rectangle-like fractals of the same iteration number N may be combined to create a Minkowski fractal island, and a resultant "fractalized" cubical quad.

An ELNEC simulation was used as a guide to far-field power patterns, resonant frequencies, and SWRs of Minkowski Island fractal antennas up to iteration N=2. Analysis for N>2 was not undertaken due to inadequacies in the test equipment available to applicant.

The following tables summarize applicant's ELNEC simulated fractal antenna designs undertaken to derive lowest frequency resonances and power patterns, to and including iteration N=2. All designs were constructed on the x,y axis, and for each iteration the outer length was maintained at 42" (106.7 cm).

Table 1, below, summarizes ELNEC-derived far field radiation patterns for Minkowski island quad antennas for each iteration for the first four resonances. In Table 1, each iteration is designed as MI-N for Minkowski Island of iteration N. Note that the frequency of lowest resonance decreased with the fractal Minkowski Island antennas, as compared to a prior art quad antenna. Stated differently, for a given resonant frequency, a fractal Minkowski Island antenna will be smaller than a conventional quad antenna.

TABLE 1

| Antenna | Res. Freq. (MHz) | Gain (dBi) | SWR | PC (for 1st) | Direction |
|---|---|---|---|---|---|
| Ref. Quad | 76 | 3.3 | 2.5 | 1 | Broadside |
| | 144 | 2.8 | 5.3 | — | Endfire |
| | 220 | 3.1 | 5.2 | — | Endfire |
| | 294 | 5.4 | 4.5 | — | Endfire |

TABLE 1-continued

| Antenna | Res. Freq. (MHz) | Gain (dBi) | SWR | PC (for 1st) | Direction |
|---|---|---|---|---|---|
| MI-1 | 55 | 2.6 | 1.1 | 1.38 | Broadside |
| | 101 | 3.7 | 1.4 | — | Endfire |
| | 142 | 3.5 | 5.5 | — | Endfire |
| | 198 | 2.7 | 3.3 | — | Broadside |
| MI-2 | 43.2 | 2.1 | 1.5 | 1.79 | Broadfire |
| | 85.5 | 4.3 | 1.8 | — | Endfire |
| | 102 | 2.7 | 4.0 | — | Endfire |
| | 116 | 1.4 | 5.4 | — | Broadside |

It is apparent from Table 1 that Minkowski island fractal antennas are multi-resonant structures having virtually the same gain as larger, full-sized conventional quad antennas. Gain figures in Table 1 are for "free-space" in the absence of any ground plane, but simulations over a perfect ground at 1λ yielded similar gain results. Understandably, there will be some inaccuracy in the ELNEC results due to round-off and undersampling of pulses, among other factors.

Table 2 presents the ratio of resonant ELNEC-derived frequencies for the first four resonance nodes referred to in Table 1.

TABLE 2

| Antenna | SWR | SWR | SWR | SWR |
|---|---|---|---|---|
| Ref. Quad (MI-0) | 1:1 | 1:1.89 | 1:2.89 | 3.86:1 |
| MI-1 | 1:1 | 1:1.83 | 1;2.58 | 3.6:1 |
| MI-2 | 1:1 | 2.02:1 | 2.41:1 | 2.74:1 |

Tables 1 and 2 confirm the shrinking of a fractal-designed antenna, and the increase in the number of resonance points. In the above simulations, the fractal MI-2 antenna exhibited four resonance nodes before the prior art reference quad exhibited its second resonance. Near fields in antennas are very important, as they are combined in multiple-element antennas to achieve high gain arrays. Unfortunately, programming limitations inherent in ELNEC preclude serious near field investigation. However, as described later herein, applicant has designed and constructed several different high gain fractal arrays that exploit the near field.

Applicant fabricated three Minkowski Island fractal antennas from aluminum #8 and/or thinner #12 galvanized groundwire. The antennas were designed so the lowest operating frequency fell close to a desired frequency in the 2 M (144 MHz) amateur radio band to facilitate relative gain measurements using 2 M FM repeater stations. The antennas were mounted for vertical polarization and placed so their center points were the highest practical point above the mounting platform. For gain comparisons, a vertical ground plane having three reference radials, and a reference quad were constructed, using the same sized wire as the fractal antenna being tested. Measurements were made in the receiving mode.

Multi-path reception was minimized by careful placement of the antennas. Low height effects were reduced and free space testing approximated by mounting the antenna test platform at the edge of a third-store window, affording a 3.5λ height above ground, and line of sight to the repeater, 45 miles (28 Km) distant. The antennas were stuck out of the window about 0.8λ from any metallic objects and testing was repeated on five occasions from different windows on the same floor, with test results being consistent within ½ dB for each trial.

Each antenna was attached to a short piece of 9913 50Ω coaxial cable, fed at right angles to the antenna. A 2 M transceiver was coupled with 9913 coaxial cable to two precision attenuators to the antenna under test. The transceiver S-meter was coupled to a volt-ohm meter to provide signal strength measurements The attenuators were used to insert initial threshold to avoid problems associated with non-linear S-meter readings, and with S-meter saturation in the presence of full squelch quieting.

Each antenna was quickly switched in for volt-ohmmeter measurement, with attenuation added or subtracted to obtain the same meter reading as experienced with the reference quad. All readings were corrected for SWR attenuation. For the reference quad, the SWR was 2.4:1 for 120Ω impedance, and for the fractal quad antennas SWR was less than 1.5:1 at resonance. The lack of a suitable noise bridge for 2 M precluded efficiency measurements for the various antennas. Understandably, anechoic chamber testing would provide even more useful measurements.

For each antenna, relative forward gain and optimized physical orientation were measured. No attempt was made to correct for launch-angle, or to measure power patterns other than to demonstrate the broadside nature of the gain. Difference of ½ dB produced noticeable S-meter deflections, and differences of several dB produced substantial meter deflection. Removal of the antenna from the receiver resulted in a $20^{+}$ dB drop in received signal strength. In this fashion, system distortions in readings were cancelled out to de more meaningful results. Table 3 summarizes these results.

TABLE 3

| Antenna | PC | PL | SWR | Cor. Gain (dB) | Sidelength (λ) |
|---|---|---|---|---|---|
| Quad | 1 | 1 | 2.4:1 | 0 | 0.25 |
| 1/4 wave | 1 | — | 1.5:1 | −1.5 | 0.25 |
| MI-1 | 1.3 | 1.2 | 1.3:1 | 1.5 | 0.13 |
| MI-2 | 1.9 | 1.4 | 1.3:1 | 1.5 | 0.13 |
| MI-3 | 2.4 | 1.7 | 1:1 | −1.2 | 0.10 |

It is apparent from Table 3 that for the vertical configurations under test, a fractal quad according to the present invention either exceeded the gain of the prior art test quad, or had a gain deviation of not more than 1 dB from the test quad. Clearly, prior art cubical (square) quad antennas are not optimized for gain. Fractally shrinking a cubical quad by a factor of two will increase the gain, and further shrinking will exhibit modest losses of 1–2 dB.

Versions of a MI-2 and MI-3 fractal quad antennas were constructed for the 6 M (50 MHz) radio amateur band. An RX 50Ω noise bridge was attached between these antennas and a transceiver. The receiver was nulled at about 54 MHz and the noise bridge was calibrated with 5Ω and 10Ω resistors. Table 4 below summarizes the results, in which almost no reactance was seen.

TABLE 4

| Antenna | SWR | Z (Ω) | O (Ω) | E (%) |
|---|---|---|---|---|
| Quad (MI-0) | 2.4:1 | 120 | 5–10 | 92–96 |
| MI-2 | 1.2:1 | 60 | ≦5 | ≧92 |
| MI-3 | 1.1:1 | 55 | ≦5 | ≧91 |

In Table 4, efficiency (E) was defined as 100%*(R/Z), where Z was the measured impedance, and R was Z minus ohmic impedance and reactive impedances (0). As shown in Table 4, fractal MI-2 and MI-3 antennas with their low ≦1.2:1 SWR and low ohmic and reactive impedance provide extremely high efficiencies, $90^{+}$%. These findings are indeed surprising in view of prior art teachings stemming from early Euclidean small loop geometries. In fact, Table 4 strongly suggests that prior art associations of low radiation impedances for small loops must be abandoned in general, to be invoked only when discussing small Euclidean loops. Applicant's MI-3 antenna was indeed micro-sized, being dimensioned at about 0.1λ per side, an area of about $\lambda^2/1{,}000$, and yet did not signal the onset of inefficiency long thought to accompany smaller sized antennas.

However the 6M efficiency data do not explain the fact that the MI-3 fractal antenna had a gain drop of almost 3 dB relative to the MI-2 fractal antenna. The low ohmic impedances of ≦5Ω strongly suggest that the explanation is other than inefficiency, small antenna size notwithstanding. It is quite possible that near field diffraction effects occur at higher iterations that result in gain loss. However, the smaller antenna sizes achieved by higher iterations appear to warrant the small loss in gain.

Using fractal techniques, however, 2 M quad antennas dimensioned smaller than 3" (7.6 cm) on a side, as well as 20 M (14 MHz) quads smaller than 3' (1 m) on a side can be realized. Economically of greater interest, fractal antennas constructed for cellular telephone frequencies (850 MHz) could be sized smaller than 0.5" (1.2 cm). As shown by FIGS. 8B and 8C, several such antenna, each oriented differently could be fabricated within the curved or rectilinear case of a cellular or wireless telephone, with the antenna outputs coupled to a circuit for coupling to the most optimally directed of the antennas for the signal then being received. The resultant antenna system would be smaller than the "rubber-ducky" type antennas now used by cellular telephones, but would have improved characteristics as well.

Similarly, fractal-designed antennas could be used in handheld military walkie-talkie transceivers, global positioning systems, satellites, transponders, wireless communication and computer networks, remote and/or robotic control systems, among other applications. Although the fractal Minkowski island antenna has been described herein, other fractal motifs are also useful, as well as non-island fractal configurations.

Table 5 demonstrates bandwidths ("BW") and multi-frequency resonances of the MI-2 and MI-3 antennas described, as well as Qs, for each node found for 6 M versions between 30 MHz and 175 MHz. Irrespective of resonant frequency SWR, the bandwidths shown are SWR 3:1 values. Q values shown were estimated by dividing resonant frequency by the 3:1 SWR BW. Frequency ratio is the relative scaling of resonance nodes.

TABLE 5

| Antenna | Freq. (MHz) | Freq. Ratio | SWR | 3:1 BW | Q |
|---|---|---|---|---|---|
| MI-3 | 53.0 | 1 | 1:1 | 6.4 | 8.3 |
| | 80.1 | 1.5:1 | 1.1:1 | 4.5 | 17.8 |
| | 121.0 | 2.3:1 | 2.4:1 | 6.8 | 17.7 |
| MI-2 | 54.0 | 1 | 1:1 | 3.6 | 15.0 |
| | 95.8 | 1.8:1 | 1.1:1 | 7.3 | 13.1 |
| | 126.5 | 2.3:1 | 2.4:1 | 9.4 | 13.4 |

The Q values in Table 5 reflect that MI-2 and MI-3 fractal antennas are multiband. These antennas do not display the very high Qs seen in small tuned Euclidean loops, and there is a lack of a mathematical application to electromagnetics to predict these resonances or Qs. One approach might be to estimate scalar and vector potentials in Maxwell's equations by regarding each Minkowski Island iteration as a series of vertical and horizontal line segments with offset positions. Summation of these segments will lead to a Poynting vector calculation and power pattern that may be especially useful in better predicting fractal antenna characteristics and optimized shapes. In practice, actual Minkowski Island fractal antennas seem to perform slightly better than their ELNEC predictions, most likely due to inconsistencies in ELNEC modeling or ratios of resonant frequencies, PCs, SWRs and gains.

Those skilled in the art will appreciate that fractal multiband antenna arrays may also be constructed. Such arrays will be smaller and present less wind area than their Euclidean counterparts, and are mechanically rotatable with a smaller antenna rotator. Fractal antenna configurations using other than Minkowski islands or loops may be implemented. Table 6 shows the highest iteration number N for other fractal configurations that were found by applicant to resonant on at least one frequency.

TABLE 6

| Fractal | Maximum Iteration |
|---|---|
| Koch | 5 |
| Torn Square | 4 |
| Minkowski | 3 |
| Mandelbrot | 4 |
| Caley Tree | 4 |
| Monkey's Swing | 3 |
| Sierpinski Gasket | 3 |
| Cantor Gasket | 3 |

Figure 9B:
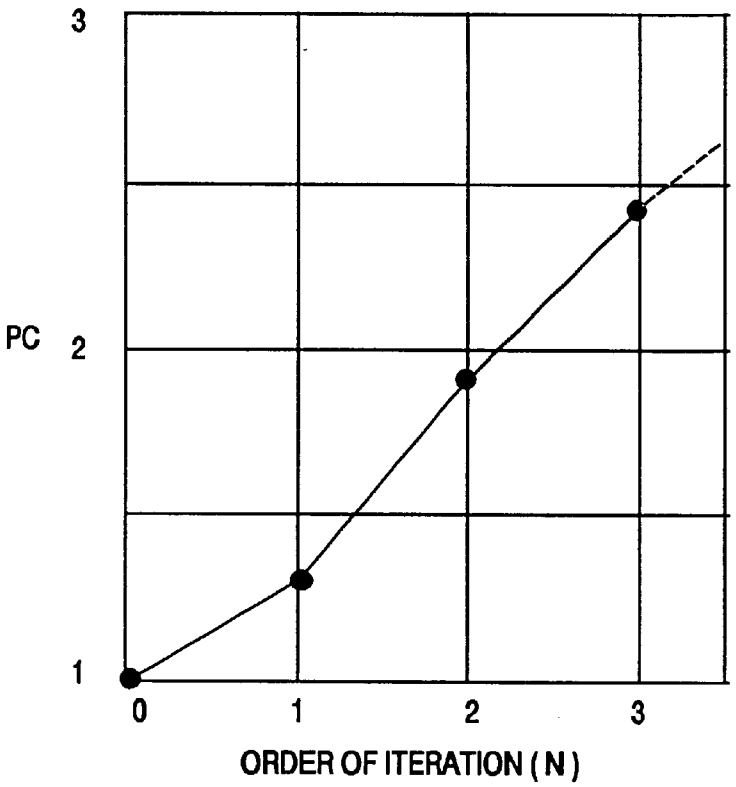
FIG. 9B depicts perimeter compression PC as a function of iteration order N for fractal antennas, according to the present invention.
Figure 9A:
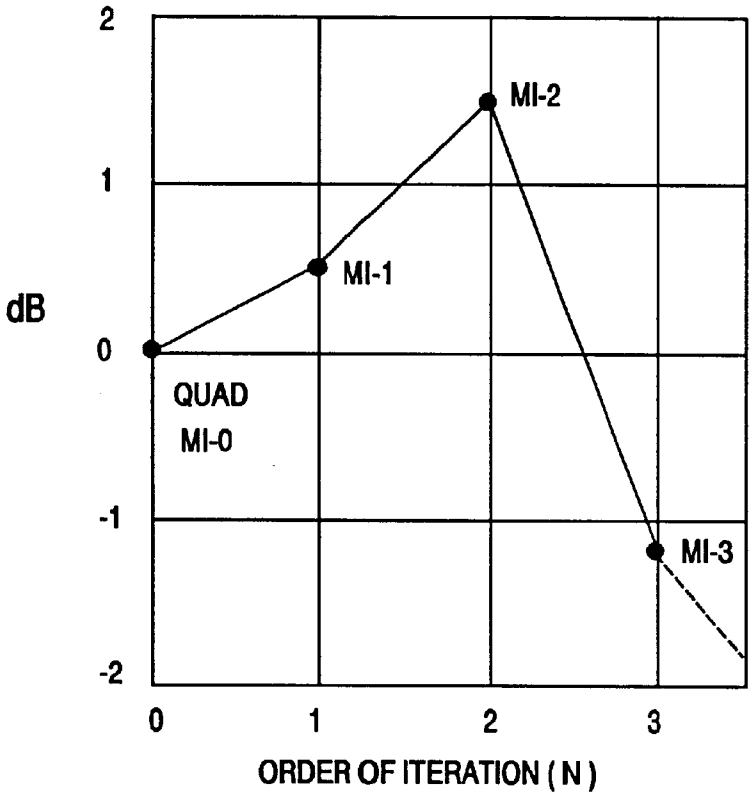
FIG. 9A depicts fractal antenna gain as a function of iteration order N, according to the present invention.

FIG. 9A depicts gain relative to an Euclidean quad (e.g., an MI-0) configuration as a function of iteration value N. (It is understood that an Euclidean quad exhibits 1.5 dB gain relative to a standard reference dipole.) For first and second order iterations, the gain of a fractal quad increases relative to an Euclidean quad. However, beyond second order, gain drops off relative to an Euclidean quad. Applicant believes that near field electromagnetic energy diffraction-type cancellations may account for the gain loss for N>2. Possibly the far smaller areas found in fractal antennas according to the present invention bring this diffraction phenomenon into sharper focus.

n practice, applicant could not physically bend wire for a 4 th or 5 th iteration 2 M Minkowski fractal antenna, although at lower frequencies the larger antenna sizes would not present this problem. However, at higher frequencies, printed circuitry techniques, semiconductor fabrication techniques as well as machine-construction could readily produce N=4, N=5, and higher order iterations fractal antennas.

In practice, a Minkowski island fractal antenna should reach the theoretical gain limit of about 1.7 dB seen for sub-wavelength Euclidean loops, but N will be higher than 3. Conservatively, however, an N=4 Minkowski Island fractal quad antenna should provide a PC=3 value without exhibiting substantial inefficiency.

FIG. 9B depicts perimeter compression (PC) as a function of iteration order N for a Minkowski island fractal configuration. A conventional Euclidean quad (MI-0) has PC=1 (e.g., no compression), and as iteration increases, PC increases. Note that as N increases and approaches 6, PC approaches a finite real number asymptotically, as predicted. Thus, fractal Minkowski Island antennas beyond iteration N=6 may exhibit diminishing returns for the increase in iteration.

It will be appreciated that the non-harmonic resonant frequency characteristic of a fractal antenna according to the present invention may be used in a system in which the frequency signature of the antenna must be recognized to pass a security test. For example, at suitably high frequencies, perhaps several hundred MHz, a fractal antenna could be implemented within an identification credit card. When the card is used, a transmitter associated with a credit card reader can electronically sample the frequency resonance of the antenna within the credit card. If and only if the credit card antenna responds with the appropriate frequency signature pattern expected may the credit card be used, e.g., for purchase or to permit the owner entrance into an otherwise secured area.

Figure 10A:
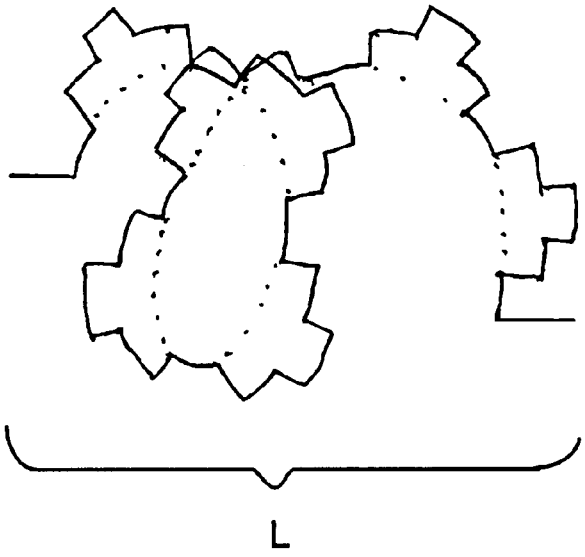
FIG. 10A depicts a fractal inductor for use in a fractal resonator, according to the present invention.
Figure 10B:
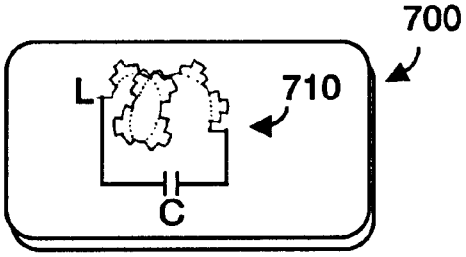
FIG. 10B depicts a credit card sized security device utilizing a fractal resonator, according to the present invention.

FIG. 10A depicts a fractal inductor L according to the present invention. In contrast to a prior art inductor, the winding or traces with which L is fabricated define, at least in part, a fractal. The resultant inductor is physically smaller than its Euclidean counterpart. Inductor L may be used to form a resonator, including resonators such as shown in FIGS. 4A and 4B. As such, an integrated circuit or other suitably small package including fractal resonators could be used as part of a security system in which electromagnetic radiation, perhaps from transmitter 600 or 660 in FIG. 8A will blow, or perhaps not blow, an LC resonator circuit containing the fractal antenna. Such applications are described elsewhere herein and may include a credit card sized unit 700, as shown in FIG. 10B, in which an LC fractal resonator 710 is implemented. (Card 700 is depicted in FIG. 10B as though its upper surface were transparent.).

The foregoing description has largely replicated what has been set forth in applicant's above-noted FRACTAL ANTENNAS AND FRACTAL RESONATORS patent application. The following section will set forth methods and techniques for tuning such fractal antennas and resonators. In the following description, although the expression "antenna" may be used in referring to a preferably fractal element, in practice what is being described is an antenna or filter-resonator system. As such, an "antenna" can be made to behave as through it were a filter, e.g., passing certain frequencies and rejecting other frequencies (or the converse).

Figure 11A:
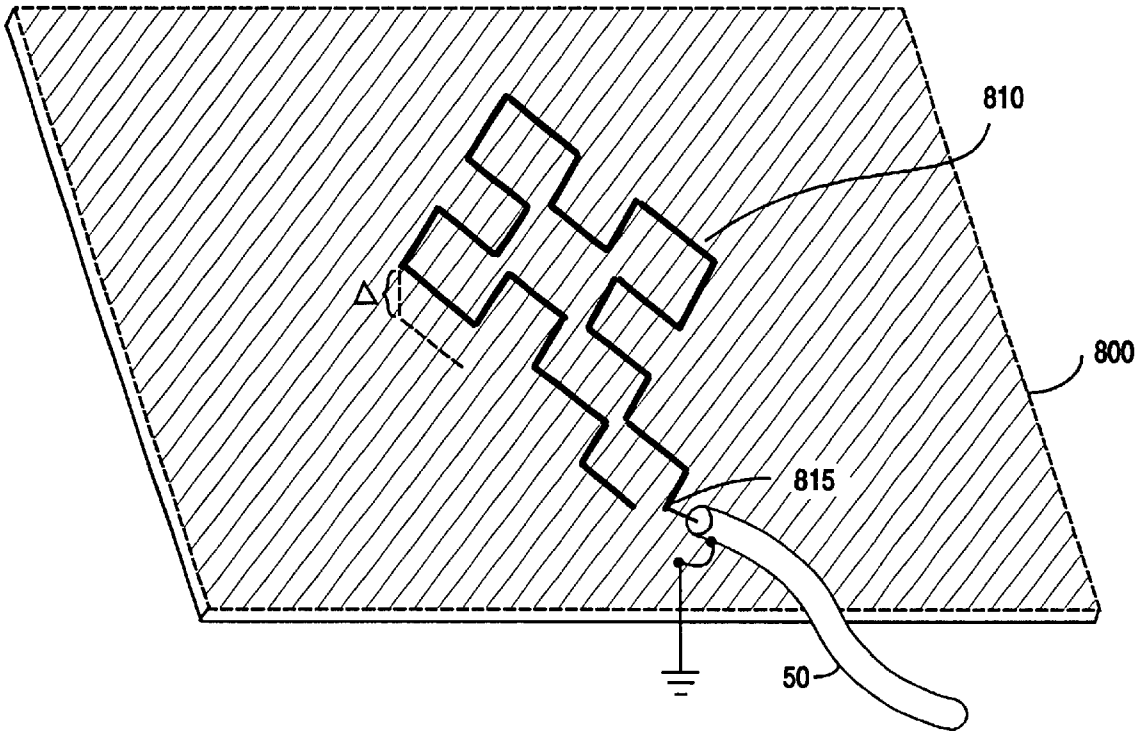
FIG. 11A depicts an embodiment in which a fractal antenna is spaced-apart a distance Δ from a conductor element to vary resonant properties and radiation characteristics of the antenna, according to the present invention.

In one group of embodiments, applicant has discovered that disposing a fractal antenna a distance Δ that is in close proximity (e.g., less than about 0.05λ for the frequency of interest) from a conductor advantageously can change the resonant properties and radiation characteristics of the antenna (relative to such properties and characteristics when such close proximity does not exist, e.g., when the spaced-apart distance is relatively great. For example, in FIG. 11A a conductive surface 800 is disposed a distance A behind or beneath a fractal antenna 810, which in FIG. 11A is a single arm of an MI-2 fractal antenna. Of course other fractal configurations such as disclosed herein could be used instead of the MI-1 configuration shown, and non-planar configurations may also be used. Fractal antenna 810 preferably is fed with coaxial cable feedline 50, whose center conductor is attached to one end 815 of the fractal antenna, and whose outer shield is grounded to the conductive plane 800. As described herein, great flexibility in connecting the antenna system shown to a preferably coaxial feedline exists. Termination impedance is approximately of similar magnitudes as described earlier herein.

In the configuration shown, the relative close proximity between conductive sheet 800 and fractal antenna 810 lowers the resonant frequencies and widens the bandwidth of antenna 810. The conductive sheet 800 may be a plane of metal, the upper copper surface of a printed circuit board, a region of conductive material perhaps sprayed onto the housing of a device employing the antenna, for example the interior of a transceiver housing 500, such as shown in FIGS. 8A, 8B, 8C, and 15.

The relationship between Δ, wherein $\Delta \leqq 0.05\lambda$, and resonant properties and radiation characteristics of a fractal antenna system is generally logarithmic.

That is, resonant frequency decreases logarithmically with decreasing separation Δ.

Figure 11B:
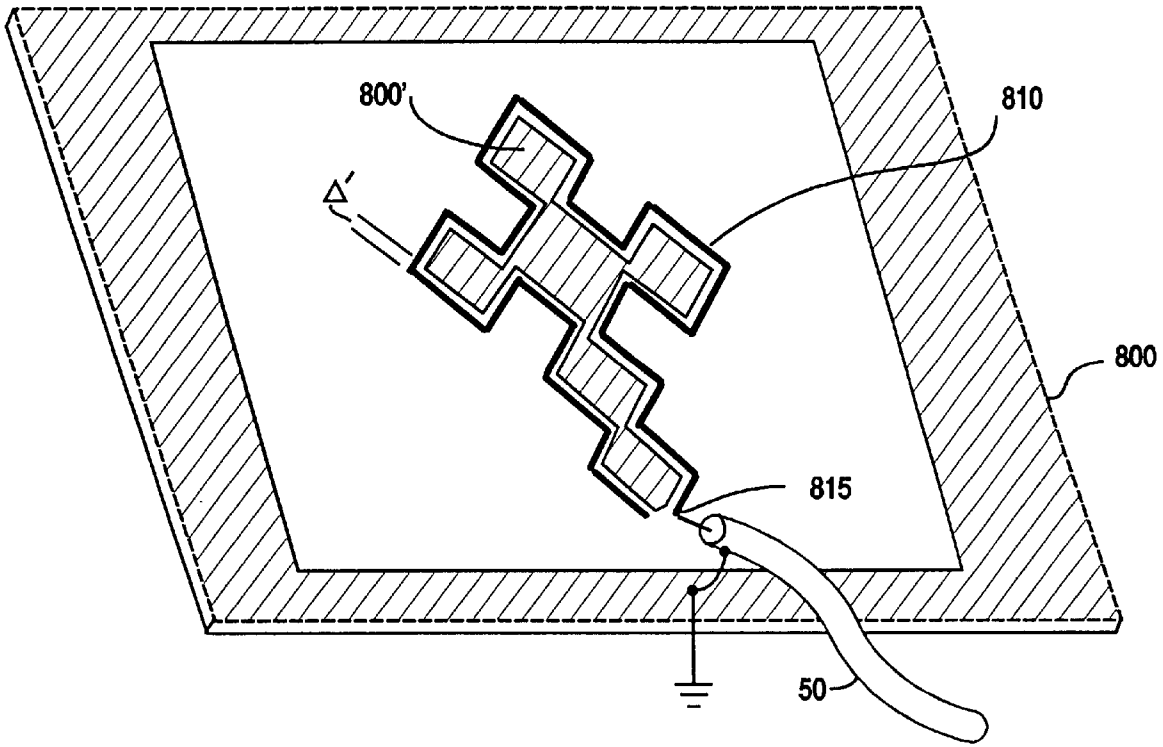
FIG. 11B depicts an embodiment in which a fractal antenna is coplanar with a ground plane and is spaced-apart a distance Δ' from a coplanar passive parasitic element to vary resonant properties and radiation characteristics of the antenna, according to the present invention.

FIG. 11B shows an embodiment in which a preferably fractal antenna 810 lies in the same plane as a ground plane 800 but is separated therefrom by an insulating region, and in which a passive or parasitic element 800' is disposed "within" and spaced-apart a distance Δ from the antenna, and also being coplanar. For example, the embodiment of FIG. 11B may be fabricated from a single piece of printed circuit board material in which copper (or other conductive material) remains to define the groundplane 800, the antenna 810, and the parasitic element 800', the remaining portions of the original material having been etched away to form the "moat-like" regions separating regions 800, 810, and 800'. Changing the shape and/or size of element 800' and/or the coplanar spaced-apart distance Δ' tunes the antenna system shown. For example, for a center frequency in the 900 MHz range, element 800' measured about 63 mm×8 mm, and elements 810 and 800 each measured about 25 mm×12 mm.

In general, element 800 should be at least as large as the preferably fractal antenna 810. For this configuration, the system shown exhibited a bandwidth of about 200 MHz, and could be made to exhibit characteristics of a bandpass filter and/or band rejection filter. In this embodiment, a coaxial feedline 50 was used, in which the center lead was coupled to antenna 810, and the ground shield lead was coupled to groundplane 800. In FIG. 11B, the inner perimeter of groundplane region 800 is shown as being rectangularly shaped. If desired, this inner perimeter could be moved closer to the outer perimeter of preferably fractal antenna 810, and could in fact define a perimeter shape that follows the perimeter shape of antenna 810. In such an embodiment, the perimeter of the inner conductive region 800' and the inner perimeter of the ground plane region 800 would each follow the shape of antenna 810. Based upon experiments to date, it is applicant's belief that moving the inner perimeter of ground plane region 800 sufficiently close to antenna 810 could also affect the characteristics of the overall antenna/resonator system.

Figure 12B:
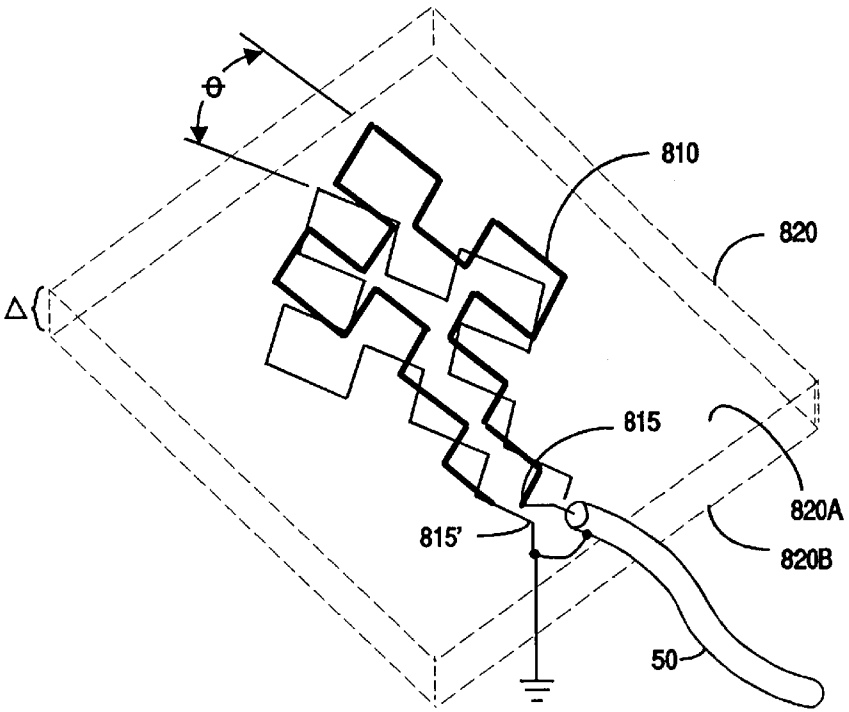
FIG. 12B depicts relative angular rotation between spaced-apart first and second fractal antennas Δ to vary resonant frequencies of the active or driven antenna, according to the present invention.
Figure 12A:
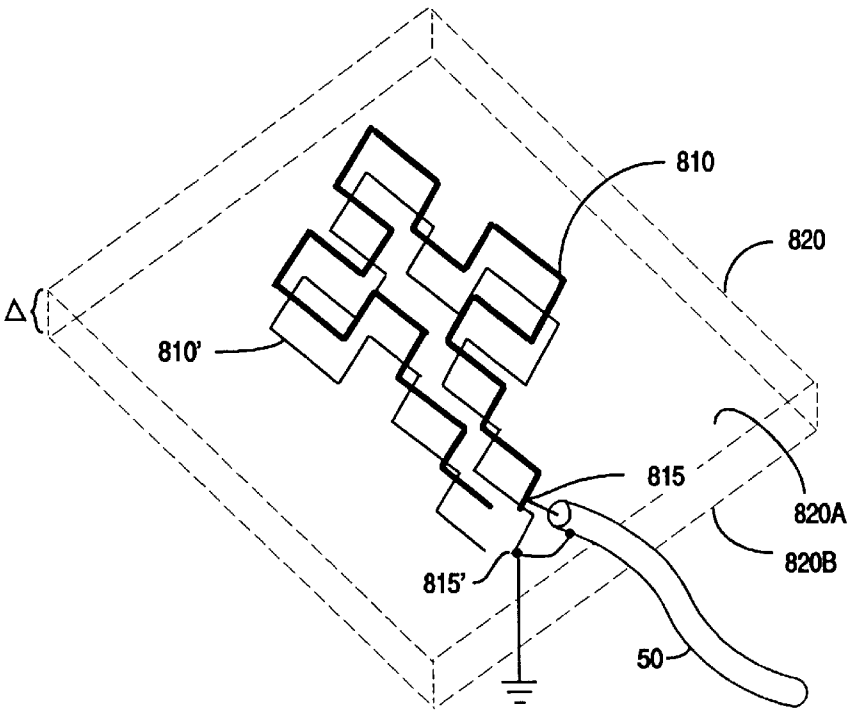
FIG. 12A depicts spacing-apart first and second fractal antennas a distance Δ to decrease resonance and create additional resonant frequencies for the active or driven antenna, according to the present invention.

Referring now to FIG. 12A, if the conductive surface 800 is replaced with a second fractal antenna 810', which is spaced-apart a distance Δ that preferably does not exceed about 0.05λ., resonances for the radiating fractal antenna 810 are lowered and advantageously new resonant frequencies emerge. For ease of fabrication, it may be desired to construct antenna 810 on the upper or first surface 820A of a substrate 820, and to construct antenna 810' on the lower or second surface 820B of the same substrate. The substrate could be doubled-side printed circuit board type material, if desired, wherein antennas 810, 810' are fabricated using printed circuit type techniques. The substrate thickness Δ is selected to provide the desired performance for antenna 810at the frequency of interest. Substrate 820 may, for example, be a non-conductive film, flexible or otherwise. To avoid cluttering FIGS. 12A and 12B, substrate 820 is drawn with phantom lines, as if the substrate were transparent.

As noted earlier, the fractal spaced-apart structure depicted in FIGS. 12A and 12B may instead be used to form a fractal element in a vertical antenna system, preferably including a fractal ground counterpoise, such as was described with respect to FIG. 8D-3.

Preferably, the center conductor of coaxial cable 50 is connected to one end 815 of antenna 810, and the outer conductor of cable 50is connected to a free end 815' of antenna 810', which is regarded as ground, although other feedline connections may be used. Although FIG. 12A depicts antenna 810' as being substantially identical to antenna 810, the two antennas could in fact have different configurations.

Applicant has discovered that if the second antenna 810' is rotated some angle Θ relative to antenna 810, the resonant frequencies of antenna 810 may be varied, analogously to tuning a variable capacitor. Thus, in FIG. 12B, antenna 810 is tuned by rotating antenna 810' relative to antenna 810 (or the converse, or by rotating each antenna). If desired, substrate 820 could comprise two substrates each having thickness Δ/2 and pivotally connected together, e.g., with a non-conductive rivet, so as to permit rotation of the substrates and thus relative rotation of the two antennas. Those skilled in the mechanical arts will appreciate that a variety of "tuning" mechanisms could be implemented to permit fine control over the angle Θ in response, for example, to rotation of a tunable shaft.

Figure 13C:
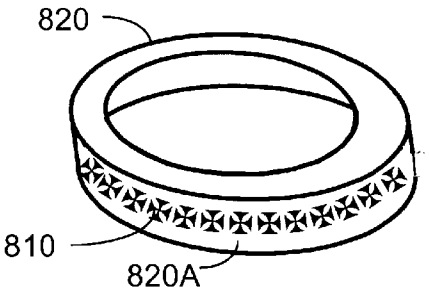
FIG. 13C depicts forming a fractal antenna or resonator on a curved torroidal form to shift resonant frequency, apparently due to self-proximity electromagnetic fields, according to the present invention.
Figure 13B:
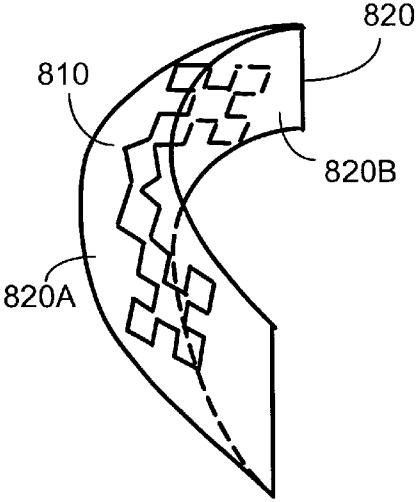
FIG. 13B depicts forming a non-planar fractal antenna or resonator on a flexible substrate that is curved to shift resonant frequency, apparently due to self-proximity electromagnetic fields, according to the present invention.
Figure 13A:
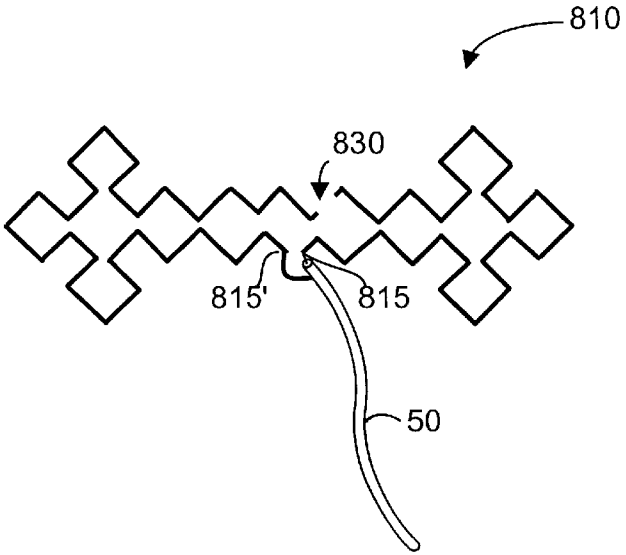
FIG. 13A depicts cutting a fractal antenna or resonator to create different resonant nodes and to alter perimeter compression, according to the present invention.

Referring now to FIG. 13A, applicant has discovered that creating at least one cut or opening 830 in a fractal antenna 810(here comprising two legs of an MI-2 antenna) results in new and entirely different resonant nodes for the antenna. Further, these nodes can have perimeter compression (PC) ranging from perhaps three to about ten. The precise location of cut 830 on the fractal antenna or resonator does not appear to be critical.

FIGS. 13B and 13C depict a self-proximity characteristic of fractal antennas and resonators that may advantageously be used to create a desired frequency resonant shift. In FIG. 13B, a fractal antenna 810 is fabricated on a first surface 820A of a flexible substrate 820, whose second surface 820B does not contain an antenna or other conductor in this embodiment. Curving substrate 820, which may be a flexible film, appears to cause electromagnetic fields associated with antenna 810 to be sufficiently in self-proximity so as to shift resonant frequencies. Such self-proximity antennas or resonators may be referred to a com-cyl devices. The extent of curvature may be controlled where a flexible substrate or substrate-less fractal antenna and/or conductive element is present, to control or tune frequency dependent characteristics of the resultant system. Com-cyl embodiments could include a concentrically or eccentrically disposed fractal antenna and conductive element. Such embodiments may include telescopic elements, whose extent of "overlap" may be telescopically adjusted by contracting or lengthening the overall configuration to tune the characteristics of the resultant system. Further, more than two elements could be provided.

In FIG. 13C, a fractal antenna 810is formed on the outer surface 820A of a filled substrate 820, which may be a ferrite core. The resultant com-cyl antenna appears to exhibit self-proximity such that desired shifts in resonant frequency are produced. The geometry of the core 820, e.g., the extent of curvature (e.g., radius in this embodiment) relative to the size of antenna 810 may be used to determine frequency shifts.

Figure 14A:
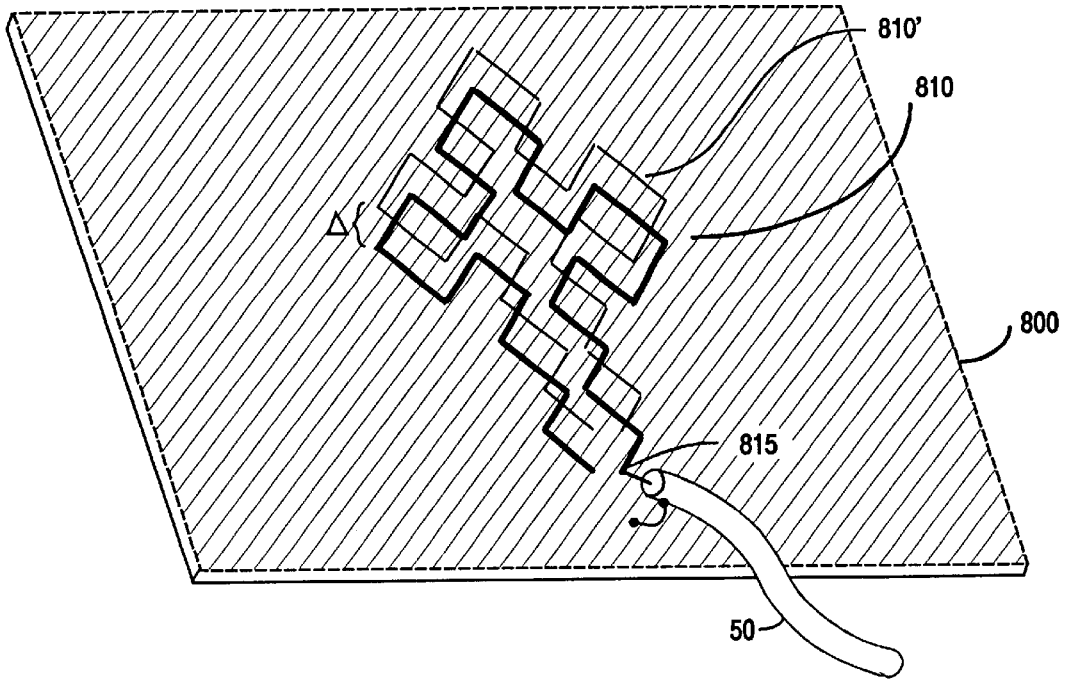
FIG. 14A depicts forming a fractal antenna or resonator in which the conductive element is not attached to the system coaxial or other feedline, according to the present invention.

In FIG. 14A, an antenna or resonator system is shown in which the non-driven fractal antenna 810' is not connected to the preferably coaxial feedline 50. The ground shield portion of feedline 50 is coupled to the groundplane conductive element 800, but is not otherwise connected to a system ground. Of course fractal antenna 810' could be angularly rotated relative to driven antenna 810, it could be a different configuration than antenna 810 including having a different iteration N, and indeed could incorporate other features disclosed herein (e.g., a cut).

Figure 14B:
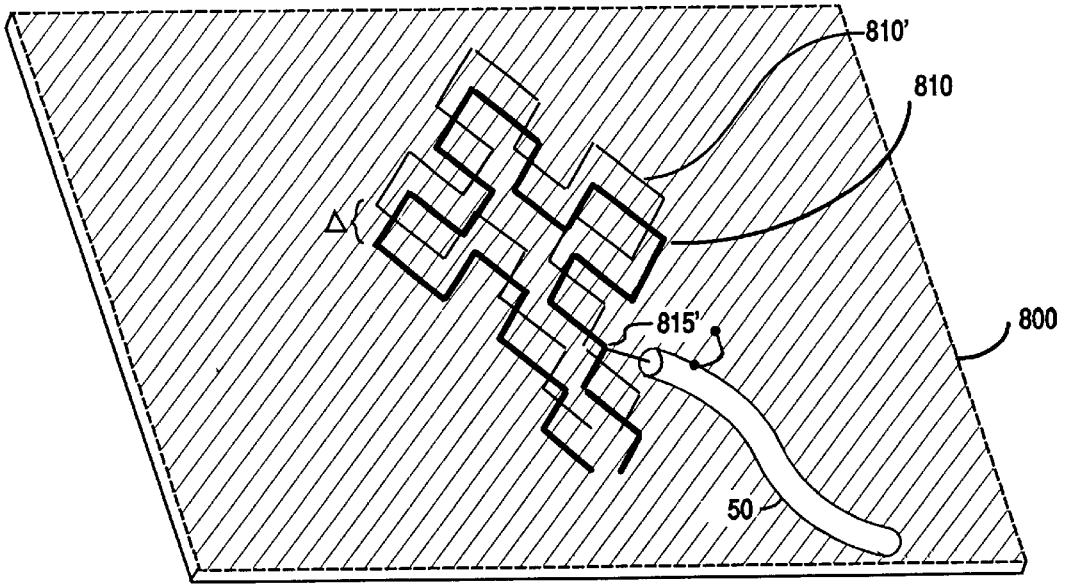
FIG. 14B depicts a system similar to FIG. 14A, but demonstrates that the driven fractal antenna may be coupled to the system coaxial or other feedline at any point along the antenna, according to the present invention.

FIG. 14B demonstrates that the driven antenna 810may be coupled to the feedline 50 at any point 815', and not necessarily at an end point 85 as was shown in FIG. 14A.

Figure 14C:
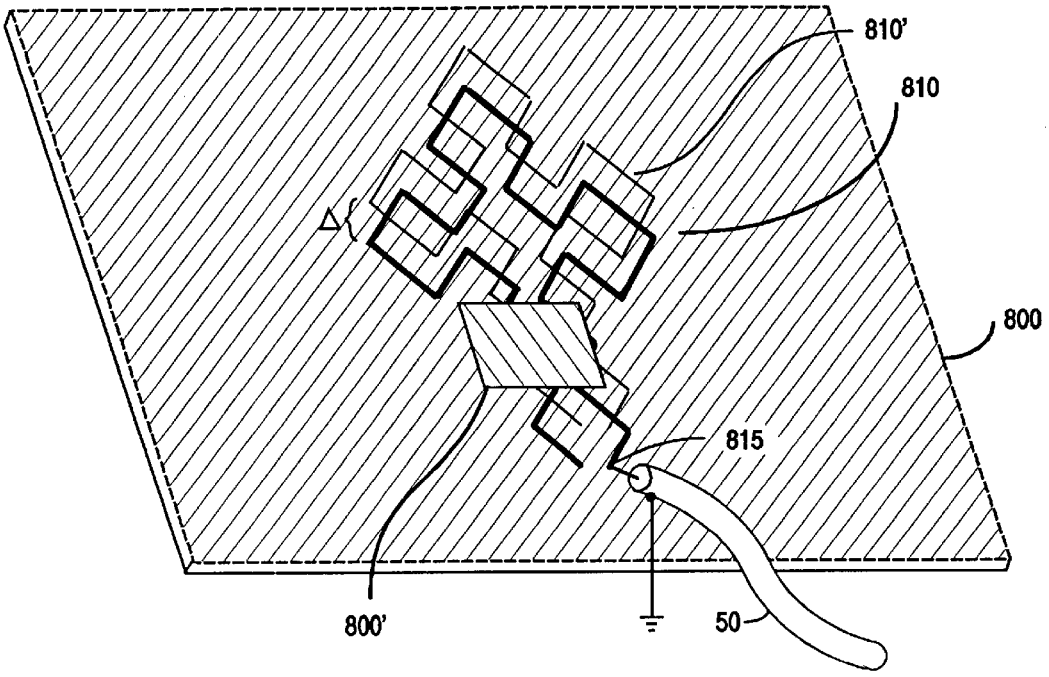
FIG. 14C depicts an embodiment in which a supplemental ground plane is disposed adjacent a portion of the driven fractal antenna and conductive element, forming a sandwich-like system, according to the present invention.

In the embodiment of FIG. 14C, a second ground plane element 800' is disposed adjacent at least a portion of the system comprising driven antenna 810, passive antenna 810', and the underlying conductive planar element 800. The presence, location, geometry, and distance associated with second ground plane element 800' from the underlying elements 810, 810', 800 permit tuning characteristics of the overall antenna or resonator system. In the multi-element sandwich-like configuration shown, the ground shield of conductor 50 is connected to a system ground but not to either ground plane 800 or 800'. Of course more than three elements could be used to form a tunable system according to the present invention.

Figure 14D:
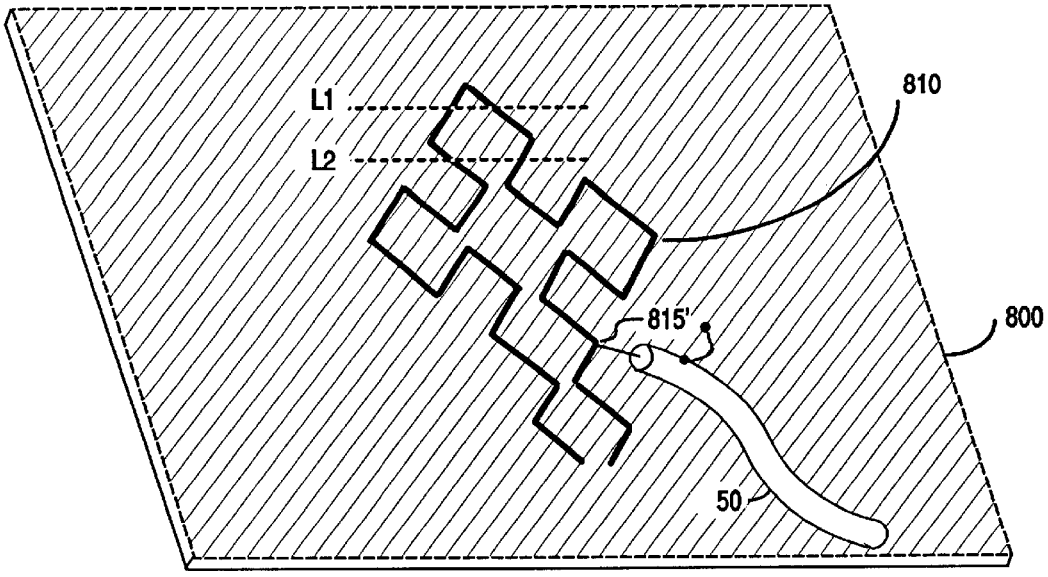
FIG. 14D depicts an embodiment in which a fractal antenna system is tuned by cutting away a portion of the driven antenna, according to the present invention.

FIG. 14D shows a single fractal antenna spaced apart from an underlying ground plane 800 a distance Δ, in which a region of antenna 800 is cutaway to increase resonance. In FIG. 14D, for example, L1 denotes a cutline, denoting that portions of antenna 810 above (in the Figure drawn) L1 are cutaway and removed. So doing will increase the frequencies of resonance associated with the remaining antenna or resonator system. On the other hand, if portions of antenna 810 above cutline L2 are cutaway and removed, still higher resonances will result. Selectively cutting or etching away portions of antenna 810 permit tuning characteristics of the remaining system.

As noted, fractal elements similar to what is generically depicted in FIGS. 14A–14D may be used to form a fractal vertical element in a fractal vertical antenna system, such as was described with respect to FIG. 7D-3.

Figure 15:
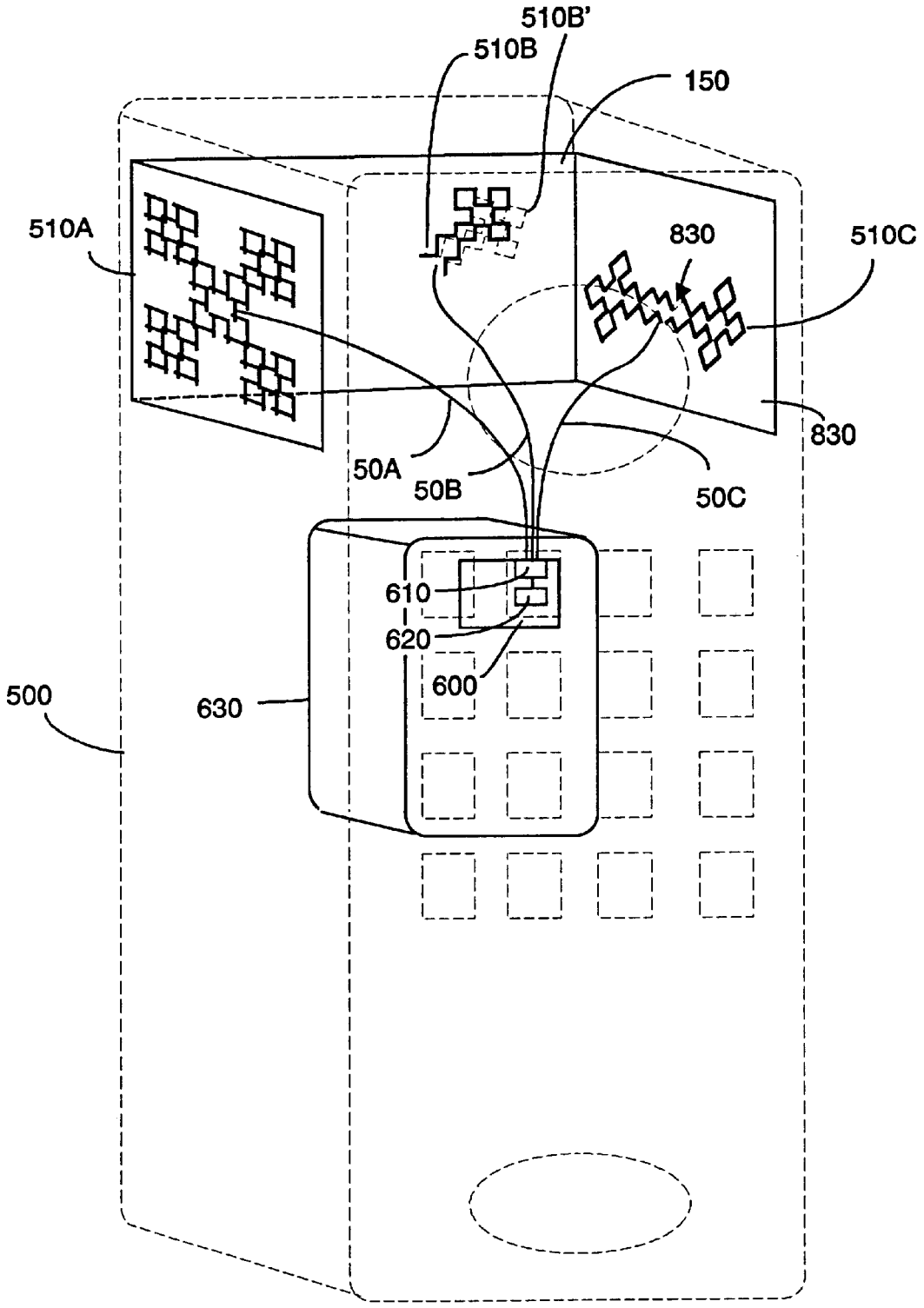
FIG. 15 depicts a communication system similar to that of FIG. 8A, in which several fractal antennas are tunable and are electronically selected for best performance, according to the present invention.

FIG. 15 depicts an embodiment somewhat similar to what has been described with respect to FIG. 8B or FIG. 8C. Once again unit 500 is a handheld transceiver, and includes fractal antennas 510A, 510B–510B', 510C. It is again understood that a vertical antenna such as elements 193 and fractal counterpoise 510D (shown in FIG. 8B) may be provided. Antennas 510B–510B' are similar to what has been described with respect to FIGS. 12A–12B. Antennas 510B–510B' are fractal antennas, not necessarily MI-2 configuration as shown, and are spaced-apart a distance Δ and, in FIG. 13, are rotationally displaced. Collectively, the spaced-apart distance and relative rotational displacement permits tuning the characteristics of the driven antenna, here antenna 510B. In FIG. 14, antenna 510A is drawn with phantom lines to better distinguish it from spaced-apart antenna 510B. Of course passive conductor 510B' could instead be a solid conductor such as described with respect to FIG. 11A. Such conductor may be implemented by spraying the inner surface of the housing for unit 500 adjacent antenna 510B with conductive paint.

In FIG. 15, antenna 510C is similar to what has been described with respect to FIG. 13A, in that a cut 830 is made in the antenna, for tuning purposes. Although antenna 510A is shown similar to what was shown in FIG. 8B, antenna 510A could, if desired, be formed on a curved substrate similar to FIG. 13B or 13C. While FIG. 15 shows at least two different techniques for tuning antennas according to the present invention, it will be understood that a common technique could instead be used. By that it is meant that any or all of antennas 510A, 510B–510B', 510C could include a cut, or be spaced-apart a controllable distance A, or be rotatable relative to a spaced-apart conductor.

As described with respect to FIG. 8B, an electronic circuit 610 may be coupled by cables 50A, 50B, 50C to the antennas, and samples incoming signals to discern which fractal antenna, e.g., 510A, 510B–510B', 510C (and, if present, antenna 510D-197) is presently most optimally aligned with the transmitting station, perhaps a unit 600 or 650 or 670 as shown in FIG. 8A. This determination may be made by examining signal strength from each of the antennas. An electronic circuit 620 then selects the presently best oriented antenna, and couples such antenna to the input of the receiver and output of the transmitter portion, collectively 630, of unit 500. It is understood that the selection of the best antenna is dynamic and can change as, for example, a user of 500perhaps walks about holding the unit, or the transmitting source moves, or due to other changing conditions. In a cellular or a wireless telephone application, the result is more reliable communication, with the advantage that the fractal antennas can be sufficiently small-sized as to fit totally within the casing of unit 500. Further, if a flexible substrate is used, the antennas may be wrapped about portions of the internal casing, as shown.

An additional advantage of the embodiment of FIG. 8B is that the user of unit 500 may be physically distanced from the antennas by a greater distance that if a conventional external whip antenna were used. Although medical evidence attempting to link cancer with exposure to electromagnetic radiation from handheld transceivers is still inconclusive, the embodiment of FIG. 8B appears to minimize any such risk.

Figure 16:
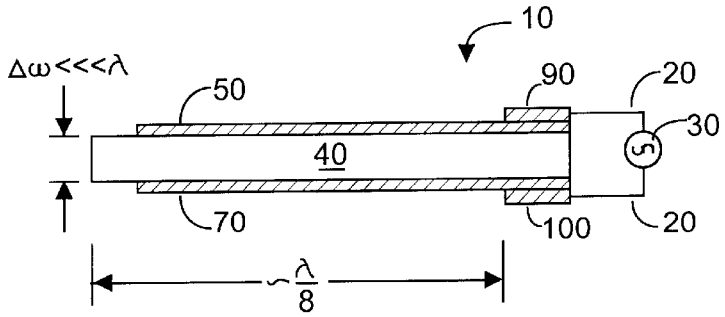
FIG. 16 is a sideview of a microstrip patch antenna with at least one fractal element, according to the present invention.
Figure 17:
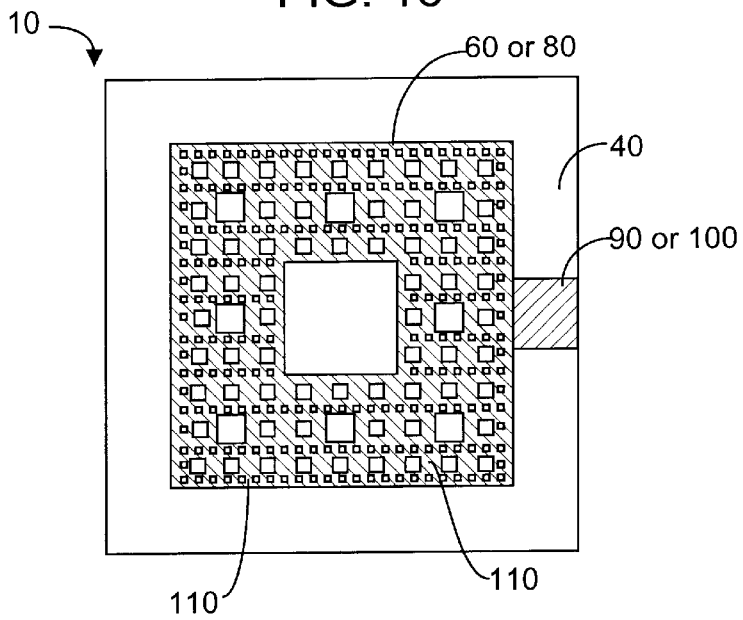
FIG. 17 is a top plan view of an exemplary fractal element (a Sierpinski square gasket), including an optional feedtab, according to the present invention.
Figure 18:
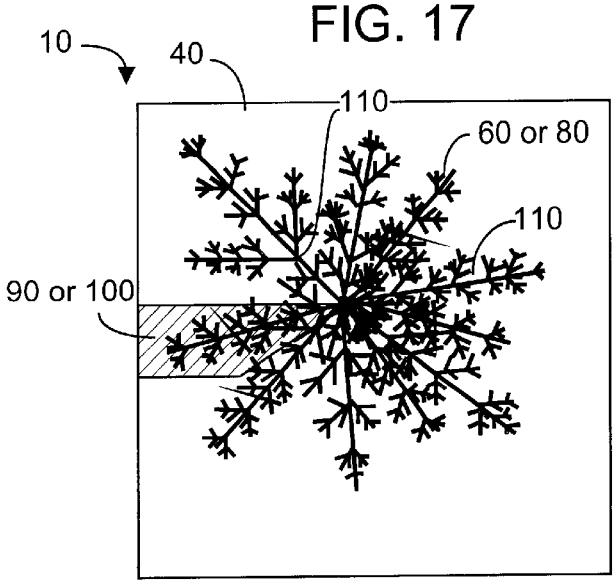
FIG. 18 is a top plan view of an exemplary alternative fractal element (a diffusion limited aggregate), including an optional feed pad, according to the present invention.

Turning now to FIGS. 16–18 , in FIG. 16, a microstrip patch antenna 10 according to the present invention is shown coupled by coaxial or other cable (or equivalent) 20 to a source of radio frequency 30. Antenna 10 comprises a substrate 40 whose top-to-bottom thickness is preferably substantially less than one wavelength at the frequency of interest, e.g., the radio frequency or band of radio frequencies coupled by cable 20 to antenna 10. Preferably the effective dimension of substrate is one-eighth wavelength at such frequency.

On its first surface, substrate 40 is initially covered by a conductive layer of material 50 that is etched away or otherwise removed in areas other than the desired fractal pattern (60) design, to expose the substrate. The remaining conductive trace portion defines a fractal element, according to the present invention.

Similarly on its second surface, substrate 40 is initially covered by a conductive layer of material 70 that is selectively removed so as to leave a desired pattern (80) that may also be a fractal pattern, according to the present invention. Alternatively, conductive material defining the desired patterns 60, 80 could be deposited upon substrate 40, rather than beginning fabrication with a substrate clad or otherwise having conductive surfaces, portions of which are removed.

Preferably feedtabs 90 and 100 are coupled, respectively, to edge regions of the first and second surfaces of substrate 40 to facilitate electrical radio frequency coupling between cable 20 and patterns 60 and/or 80. These feedtabs preferably are etched using the same conductive material originally found on the upper or lower surfaces of substrate 40, or may otherwise be formed using techniques known to those skilled in the relevant art. If patterns 60and 80 are deposited rather than etched, then feedtabs 90, 100 may be deposited at the same fabrication step.

Substrate 40 is a non-conductive material, and by way of example may be a silicon wafer, a rigid or a flexible plastic-like material, perhaps Mylar™ material, or the non-conductive portion of a printed circuit board, paper, epoxy, among other materials. The original conductive material on the first and/or second surfaces may be deposited doped polysilicon for a semiconductor substrate 40, or copper (or other conductor) for a printed circuit board substrate.

FIG. 17 is a plan view of one surface of antenna 10 (it matters not which), and depicts a first iteration fractal conductive pattern, although a fractal pattern with higher than first iteration could instead be used. The pattern shown in FIG. 2 is often referred to as a Sierpinski (square) gasket pattern. A margin is shown in FIG. 17 between the outer perimeter of the pattern and the edge of the substrate; however no such margin is required. Although FIG. 2 shows inclusion of feedtab 90 or 100, radio frequency feed may be made elsewhere on the surface, for example at any point 110.

If the fractal pattern of FIG. 17 represents one surface of antenna 10, the opposite surface need not define a fractal pattern, but may in fact do so. For example, one surface may define a fractal pattern and the opposite surface may be entirely conductive, or may define on the substrate a conductive circle, etc. If the pattern on the opposite surface is also a fractal, there is no requirement that it be the same iteration fractal as is defined on the first surface, or that it be the same fractal type. While common fractal families include Koch, Minkowski, Julia, diffusion limited aggregates, fractal trees, Mandelbrot, microstrip patch antennas with fractal element(s) according to the present invention may be implemented with other fractals as well.

FIG. 18 depicts a pattern 60or 80in which a different fractal pattern is defined, a so-called diffusion limited aggregate pattern. It is understood, however, that according to the present invention, a great variety of fractal patterns of first or higher iteration may be defined on the first and/or second surface of antenna 10. In FIG. 18, while a feedtab 90 or 100 is shown, it is again understood that radio frequency feed may be made essentially anywhere on the fractal pattern, e.g., at a point 110.

In one embodiment, applicant fabricated an antenna 10 having sides dimensioned to about one-eighth wavelength for a frequency of about 900 MHz. Those skilled in the art will readily appreciate that a microstrip patch antenna dimensioned to one-eighth wavelength is substantially smaller than prior art non-fractal microstrip patch antennas, in which dimensions are one-quarter or one-half wavelength in size. At 900 MHz, bandwidth was about 5% to about 8% of nominal frequency. Gain and matching impedance were acceptable, and indeed substantially 50Ω impedance is realized without the need for impedance transforming devices.

Modifications and variations may be made to the disclosed embodiments without departing from the subject and spirit of the invention as defined by the following claims. While common fractal families include Koch, Minkowski, Julia, diffusion limited aggregates, fractal trees, Mandelbrot, ground counterpoise elements and/or top-hat loading elements according to the present invention may be implemented with other fractals as well.

What is claimed is:

1. An antenna system including:

a driven element, and at least one element a portion of which is a fractal element selected from a group consisting of (a) a fractal counterpoise element, and (b) a microstrip patch element;

wherein said fractal element is defined as a superposition over at least N=1 iterations of a fractal generator motif, an iteration being placement of said fractal generator motif upon a base figure through at least one positioning selected from the group consisting of (i) rotation, (ii) stretching, and (iii) translation.

2. The antenna system of claim 1, wherein said fractal generator motif has x-axis, y-axis coordinates for a next iteration N+1 defined by $x_{N+1}=f(x_N, y_N)$ and $y_{N+1}=g(x_N, y_N)$, where $x_N$, $y_N$ are coordinates for iteration N, and where f(x,y) and g(x,y) are functions defining said fractal generator motif and behavior.

3. The antenna system of claim 2, wherein said fractal generator motif is selected from a family consisting of (i) Koch, (ii) Minkowski, (iii) Cantor, (iv) torn square, (v) Mandelbrot, (vi) Caley tree, (vii) monkey's swing, (viii) Sierpinski gasket, and (ix) Julia.

4. An antenna system including:

a driven element, and at least one element a portion of which is a fractal element selected from a group consisting of (a) a fractal counterpoise element, and (b) a microstrip patch element;

wherein said antenna system has a perimeter compression parameter (PC) defined by:

$$PC = \frac{\text{full-sized antenna element length}}{\text{Fractal-reduced antenna element length}}$$

where:

$$PC = A - \log\{N(D+C)\}$$

in which A and C are constant coefficients for a given said fractal generator motif, N is an iteration number, and D is a fractal dimension given by log(L)/log(r), where L and r are one-dimensional antenna element lengths before and after fractalization, respectively.

5. An antenna system including:

a driven element, and at least one element a portion of which is a fractal element selected from a group consisting of (a) a fractal counterpoise element, and (b) a microstrip patch element;

wherein:

said antenna system is a vertical antenna system;

said fractal element includes three fractal dendrite elements of overall length approximating 0.087λ; and wherein gain is substantially at least within 1 dB of unity.

6. A fractal antenna coupleable to a transceiver unit, the antenna comprising:

a driven element, and at least one fractal element selected from a group consisting of (a) a fractal counterpoise element, and (b) a microstrip patch element, said fractal element having a physical shape defined substantially as a deterministic fractal of iteration N≧2 for at least a portion of said element;

wherein said fractal is defined as a superposition over at least N=2 iterations of a fractal generator motif, an iteration being placement of said fractal generator motif upon a base figure through at least one positioning selected from the group consisting of (i) rotation, (ii) stretching, and (iii) translation; and wherein said fractal generator motif has x-axis, y-axis coordinates for a next iteration N+1 defined by $x_{N+1} = f(X_N, Y_N)$ and $Y_{N+1} = g(X_N, Y_N)$ where $X_N$, $Y_N$ are coordinates for iteration N, and where f(x,y) and g(x,y) are functions defining said fractal generator motif and behavior.

7. The antenna of claim 6, wherein said fractal generator motif is selected from a family consisting of (i) Koch, (ii) Minkowski, (iii) Cantor, (iv) torn square, (v) Mandelbrot, (vi) Caley tree, (vii) monkey's swing, (viii) Sierpinski gasket, and (ix) Julia.

8. An antenna system including:

a driven element, and at least one element a portion of which is a fractal element selected from a group consisting of (a) a fractal counterpoise element, and (b) a microstrip patch element;

wherein said antenna system has a perimeter compression parameter (PC) defined by:

$$PC = A - \log\{N(D+C)\}$$

in which A and C are constant coefficients for a given said fractal generator motif, N is an iteration number, and D is a fractal dimension given by log(L)/log(r), where L and r are one-dimensional antenna element lengths before and after fractalization, respectively.

* * * * *